US008702059B2

(12) United States Patent
Wieland

(10) Patent No.: US 8,702,059 B2
(45) Date of Patent: Apr. 22, 2014

(54) ELEVATED PLATFORM AND METHOD OF ELEVATING THE SAME

(75) Inventor: Craig Wieland, Mason, MI (US)

(73) Assignee: Craig Wieland, Celebration, FL (US)

( * ) Notice: Subject to any disclaimer, the term of this patent is extended or adjusted under 35 U.S.C. 154(b) by 880 days.

(21) Appl. No.: 12/830,780

(22) Filed: Jul. 6, 2010

(65) Prior Publication Data

US 2011/0162911 A1 Jul. 7, 2011

Related U.S. Application Data

(63) Continuation-in-part of application No. 11/602,603, filed on Nov. 21, 2006, now Pat. No. 7,926,787.

(51) Int. Cl.
*B66F 3/40* (2006.01)

(52) U.S. Cl.
USPC ..... 254/93 HP; 254/93 R

(58) Field of Classification Search
USPC ..... 254/93 HP, 93 R, 2 B
See application file for complete search history.

(56) References Cited

U.S. PATENT DOCUMENTS

| | | | | |
|---|---|---|---|---|
| 1,745,959 | A | 2/1930 | Steiner | |
| 3,015,470 | A * | 1/1962 | Patchen | 254/93 HP |
| 3,673,975 | A | 7/1972 | Strauss | |
| 3,695,582 | A | 10/1972 | Clay | |
| 3,843,092 | A * | 10/1974 | Oehler | 254/93 HP |
| 4,061,310 | A | 12/1977 | Vetter | |
| 4,074,474 | A | 2/1978 | Cristy | |
| 4,948,107 | A | 8/1990 | Orndorff, Jr. | |
| 4,967,985 | A | 11/1990 | Deakin | |
| 5,347,949 | A | 9/1994 | Winston | |
| 5,492,300 | A * | 2/1996 | Riihiluoma et al. | 248/354.1 |
| 5,593,352 | A | 1/1997 | Methfessel et al. | |
| 5,743,049 | A | 4/1998 | Thallemer | |
| 5,775,847 | A | 7/1998 | Carlinsky et al. | |
| 5,904,446 | A | 5/1999 | Carlinsky et al. | |
| 6,000,942 | A | 12/1999 | Hogue et al. | |
| 6,082,708 | A * | 7/2000 | Mullican et al. | 254/93 HP |
| 6,092,788 | A * | 7/2000 | Simon | 254/93 HP |
| 6,199,827 | B1 | 3/2001 | Rimington et al. | |
| 6,929,249 | B1 * | 8/2005 | Kim | 254/93 HP |
| 7,070,167 | B1 | 7/2006 | Bacon et al. | |
| 7,926,787 | B2 * | 4/2011 | Wieland | 254/93 HP |
| 2008/0116018 | A1 | 5/2008 | Wieland | |
| 2010/0264386 | A1 * | 10/2010 | Dvorak | 254/93 HP |
| 2011/0162911 | A1 * | 7/2011 | Wieland | 182/141 |

OTHER PUBLICATIONS

International Preliminary Report on Patentability for PCT/US07/085343 dated May 26, 2009.
International Search Report for PCT/US07/85343 dated May 13, 2008.
Written Opinion for PCT/07/85343 dated May 13, 2008.

* cited by examiner

*Primary Examiner* — Lee D Wilson
(74) *Attorney, Agent, or Firm* — Brinks Gilson & Lione

(57) ABSTRACT

An elevated platform is provided. The elevated platform includes a platform, a central support structure, and an inflatable bladder structure. The inflatable bladder structure is coupled to and partially encases the central support structure. The inflatable bladder structure is also coupled to the platform so that the platform is moved in a first direction as the inflatable bladder structure is inflated and the platform is moved in a second direction opposite the first direction as the inflatable bladder structure is deflated.

12 Claims, 23 Drawing Sheets

139

ELEVATED PLATFORM AND METHOD OF ELEVATING THE SAME

This application is a continuation-in-part of U.S. patent application Ser. No. 11/602,603, filed on Nov. 21, 2006, now U.S. Pat. No. 7,926,787 and wherein the above mentioned U.S. regular application is incorporated in its entirety by reference herein.

BACKGROUND

Various platforms are used to provide unobstructed views of sunsets, lakes, landscapes, mountains, local sporting events, or other visually appealing scenes. Platforms have also been used for other recreational activities. One common platform is the residential deck, which provides the user a measure of privacy. Generally, the residential deck is rigidly attached to the ground or a building and is unable to elevate to a desired variable height so as to obtain an unobstructed view of the surrounding area.

Conventionally, platforms have been raised using hydraulics, telescoping tubes, scissor lifts, or simply designing the platform at a predetermined height and accessing the platform using a ladder. These conventional mechanisms are expensive, complicated to install, or are dangerous to access. Accordingly, a simplified elevated platform is desired.

SUMMARY

The present invention is defined by the following claims, and nothing in this section should be taken as a limitation on those claims.

By way of introduction, the embodiments presented herein relate to an elevated platform. In one preferred embodiment, an elevated platform is provided. The elevated platform includes a platform, a central support structure, and an inflatable bladder structure. The inflatable bladder structure is coupled to and partially encases the central support structure. The inflatable bladder structure is also coupled to the platform so that the platform is moved in a first direction as the inflatable bladder structure is inflated and the platform is moved in a second direction opposite the first direction as the inflatable bladder structure is deflated.

In another preferred embodiment, an elevated platform is provided with a platform and an inflatable bladder structure coupled to the platform. The inflatable bladder structure is operable to raise or lower the platform from a first position to a second position using low pressure, high volume gas. A stabilizing element is coupled to the platform and resists lateral movement.

The embodiments will now be described with reference to the attached drawings.

BRIEF DESCRIPTION OF THE DRAWINGS

FIG. 12A is an elevated three-dimensional side view of a base pan for use with the elevated platform of FIG. 1 and in accordance with the present invention.

DETAILED DESCRIPTION

U.S. patent application Ser. No. 11/602,603, filed on Nov. 21, 2006, describes an elevated platform that uses inflatable bladders for raising and lowering a platform. The entire contents of U.S. patent application Ser. No. 11/602,603 are herein incorporated by reference into this application.

Figure 1:
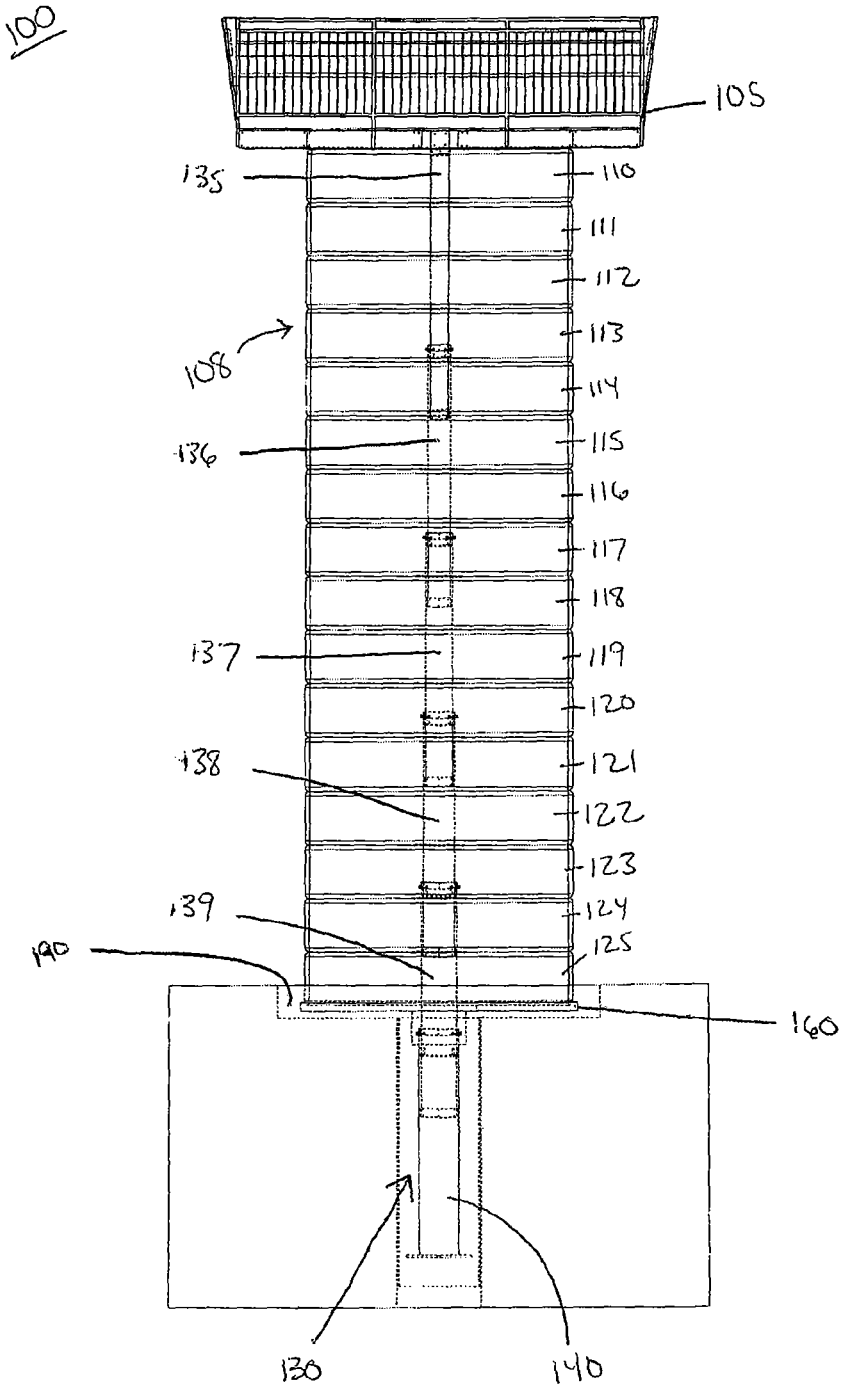
FIG. 1 is a cross-sectional side view of one embodiment of an elevated platform in the elevated position in accordance with the present invention.
Figure 2:
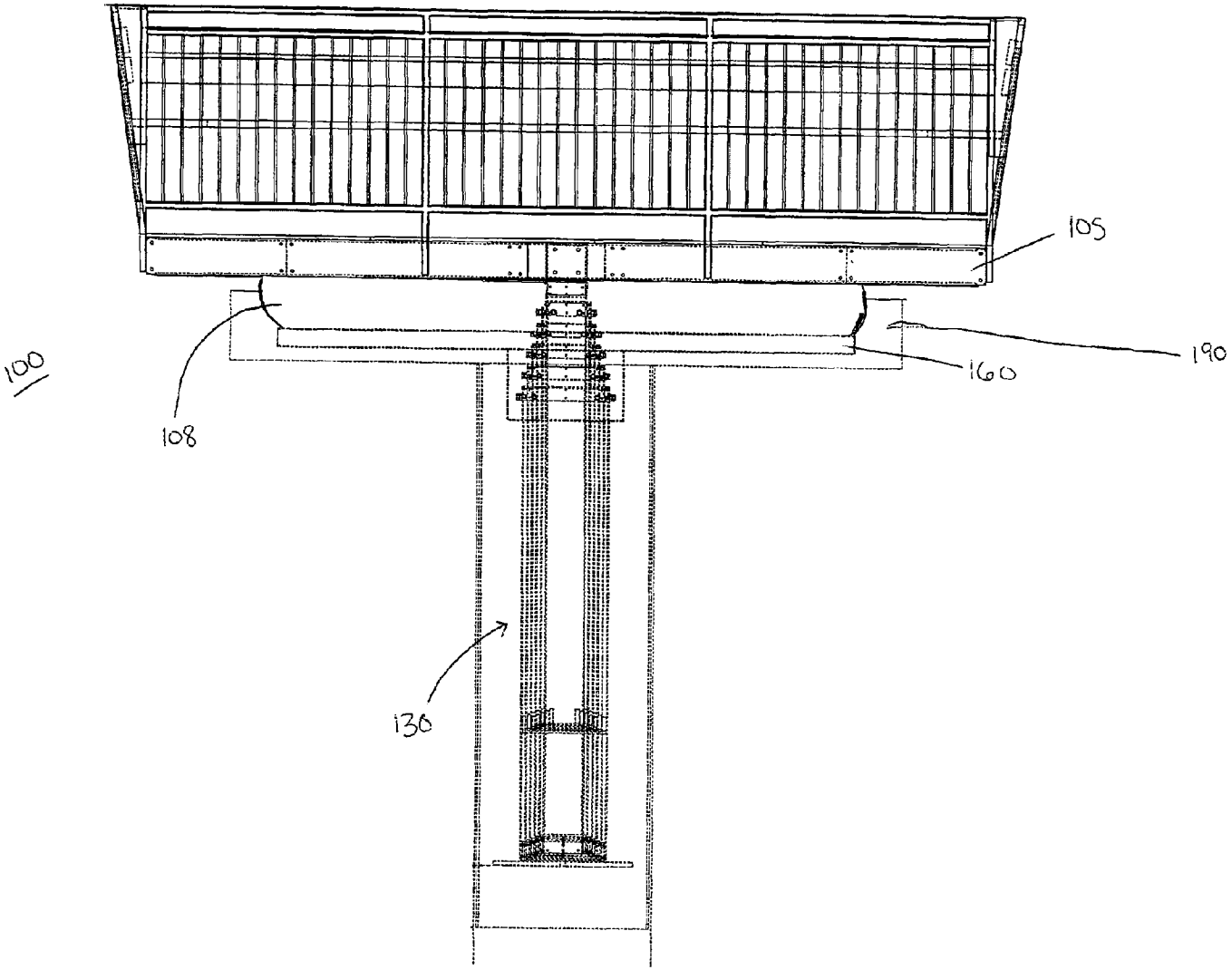
FIG. 2 is a cross-sectional side view of the embodiment of the elevated platform of FIG. 1 in the deflated position in accordance with the present invention.
Figure 3:
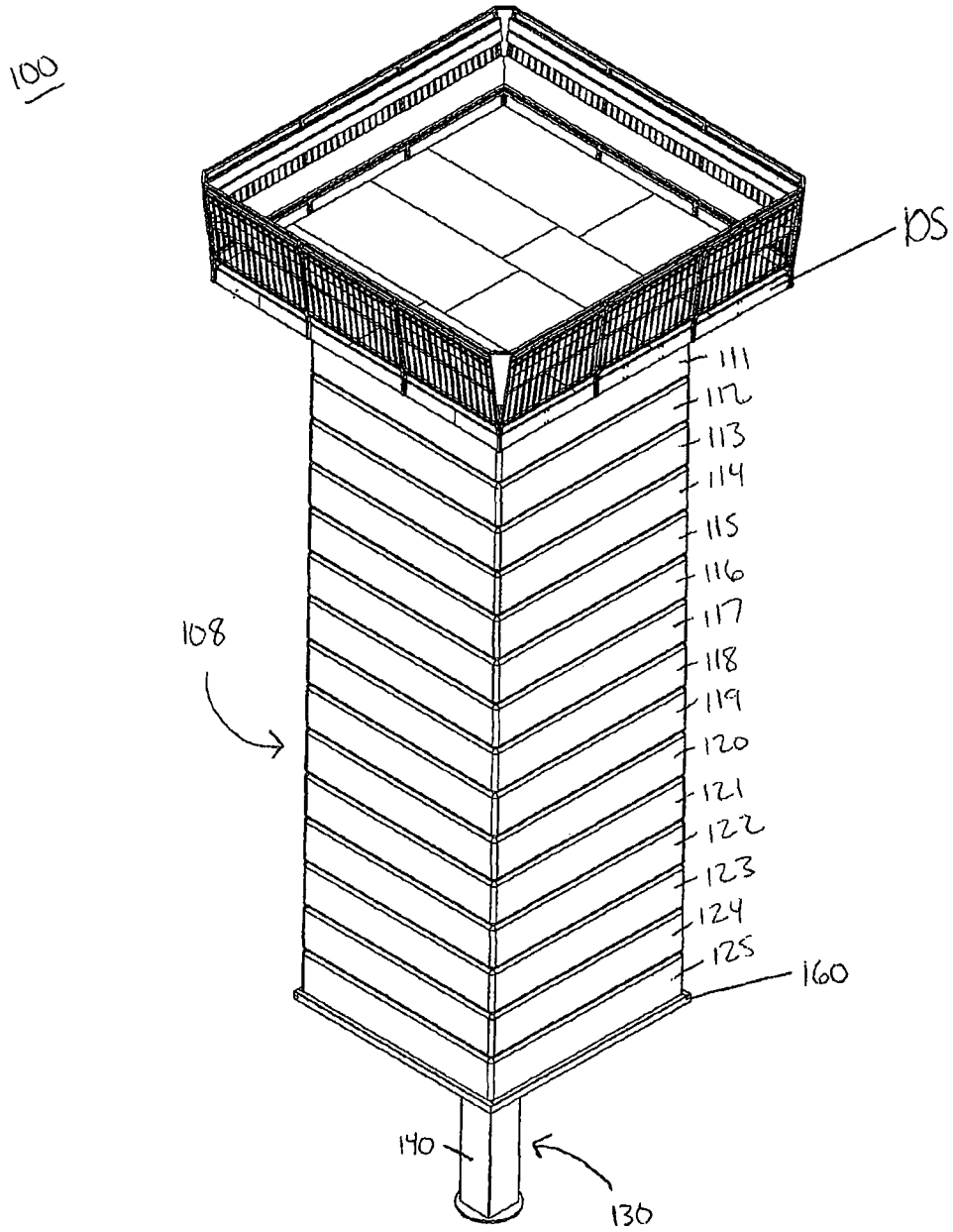
FIG. 3 is an elevated side view of the embodiment of the elevated platform of FIG. 1 in the elevated position and in accordance with the present invention.

FIG. 1 shows a cross-sectional side view of one embodiment of an elevated platform 100 in the elevated position. The elevated platform 100 in FIG. 1 includes a platform 105; a bladder structure 108 that includes bladder cushions 110-125; a central support structure 130 that includes tubes 135-140; and a base pan 160. FIG. 2 shows a transparent side view of the same embodiment of the elevated platform 100 as shown in FIG. 1, but in FIG. 2 the elevated platform 100 is in the deflated or compressed position. FIG. 3 shows an elevated side view of the same embodiment of an elevated platform 100 as shown in FIGS. 1 and 2, with the elevated platform 100 in the elevated position.

The elevated platform 100 of FIGS. 1 and 2 may function or operate so as to raise a platform 105 from the ground level, shown in the deflated position shown in FIG. 2, to an elevated position a desired height above the ground, as shown in FIG. 1.

The elevated platform 100 may have at least two primary stationary and/or stable positions. In a first stationary and/or stable position, the elevated platform 100 may be in a deflated position, as shown in FIG. 2. In the deflated position, the platform 105 may be at or near ground level, such that a user may be able to easily step onto platform 105 from the ground. In preferred embodiments, the user may step onto the platform 105 with little or no step up or down. In the deflated position, the bladder structure 108 is nearly or completely deflated and rests below the platform 105, but above the base pan 160. In some embodiments, a cavity 190 may optionally exist to accommodate the deflated bladder structure 108 while facilitating the positioning of the platform 105 at or near ground-level. In the deflated position, the central support structure 130 may be compacted or shrunk into itself, as shown in FIG. 2. In embodiments where the central support structure 130 utilizes a number of tubes 135-140, this compacted or shrunk orientation may be accomplished by using tubes or poles of different cross-sectional sizes, such that each of the tubes or poles fits inside each other, as shown in FIG. 2. Alternatively, in other embodiments, the central support structure 130 may be one free-standing pole of a desired height which does not move and is not compacted. The first stationary position described above and shown in FIG. 2 may be referred to as a deflated position, a compressed position, a ground-level position, a buried position, a compacted position, or any other type of position indicating that the bladder structure 108 is not inflated and that the platform 105 may be at or near ground-level.

The elevated platform 100 may move from the deflated position shown in FIG. 2 to the stationary inflated or elevated position shown in FIGS. 1 and 3. In the inflated or elevated position as shown in FIGS. 1 and 3, the bladder structure 108 and/or some or all of its bladder cushions 110-125 may be fully inflated or expanded. The central support structure 130 may be expanded to a height equivalent or greater than that of the bladder structure 108. The central support structure 130 may expanded by the bladder structure 108. The platform 105 may be connected to the central support structure 130 and/or may rest on or be connected to the top of the bladder structure 108. In this elevated position, the platform 105 may be at a desired height above the ground, generally located on top of the inflated bladder structure 108. This second inflated position shown in FIGS. 1 and 3 may be referred to as an inflated position, an elevated position, an expanded position, a raised position, or any other type of position indicating that the platform 105 is elevated above the ground level. In preferred embodiments, the platform 105 may be raised, moved, or ascend to a maximum height of 36 feet in the elevated position of FIG. 1. In other embodiments, the platform 105 may achieve a maximum height of greater or less than 36 feet.

The elevated platform 100 may move from the deflated position to the elevated position, and may move from the elevated position to the deflated position. Additionally, the elevated platform 100 may move from any first position between the deflated position and the elevated position to any second position between the deflated position and the elevated position. The elevated platform 100 may be stable and secure in both the elevated position and the deflated position, as well as any position in between the elevated position and the deflated position.

The movement of the elevated platform 100, and in particular the raising or lifting movement of the elevated platform 100 from any first position, such as the deflated position in FIG. 2, to any higher second position, such as the inflated position of FIG. 1, may be accomplished by inflating the bladder structure 108 and/or each of the bladder cushions 110-125. An inflating device such as a blower (not shown) may be connected to the bladder structure 108 and may be used to propel a gas or other fluid into the bladder structure 108. In preferred embodiments, low pressure, high volume air or gas is used to inflate the bladder structure 108. In more preferred embodiments, the low pressure, high volume air or gas is not volatile. The top of the bladder structure 108, as it is inflated, may apply a force to the bottom of the platform 105 and/or to the central support structure 130. This force may be in the upward direction pushing the platform 105 and/or the central support structure 130 away from the ground. Preferably this force is evenly distributed across the bottom of the platform 105 and preferably the force distributed to the bottom of the platform 105 is directed along the vertical axis of the elevated platform 100, with little or no lateral force applied by the bladder structure 108 to the platform 105. When this force is great enough, the platform 105 may rise and/or the central support structure 130 may expand from its contracted position shown in FIG. 2 until it reaches its expanded position shown in FIGS. 1 and 3. In preferred embodiments, this force is greater than the gravitational force of the platform 105. The expanded central support structure 130, as shown in FIG. 1, may provide support for the elevated platform 100 preventing side to side movement, swaying, or tipping over.

The elevated platform 100 may move from the inflated position shown in FIG. 1 to a deflated position shown in FIG. 2, or from any position to a second position at a lower height, by releasing the gas from inside the bladder structure 108. The elevated platform is shown throughout as operating with an up and down movement, but the elevated platform may alternatively operate so as to move a platform 105 from any first position in any first direction to any second position, and back in a second direction opposite the first direction. For example, in some embodiments, the platform 105 is moved in a horizontal direction.

In some preferred embodiments, the elevated platform 100 may move from the deflated position in FIG. 2 to the inflated position in FIG. 1, to a height of 36 feet above the ground, in around 10-20 minutes. In some preferred embodiments, the elevated platform 100 may descend from the inflated position in FIG. 1 to the deflated position of FIG. 2 in about 5 minutes.

The inflation and deflation of the bladder structure 108 may be gradual and may apply a steady and constant force against the bottom of the platform 105 and/or the central support structure 130 so as to provide steady, stable, and/or smooth ascent and descent.

Figure 4:
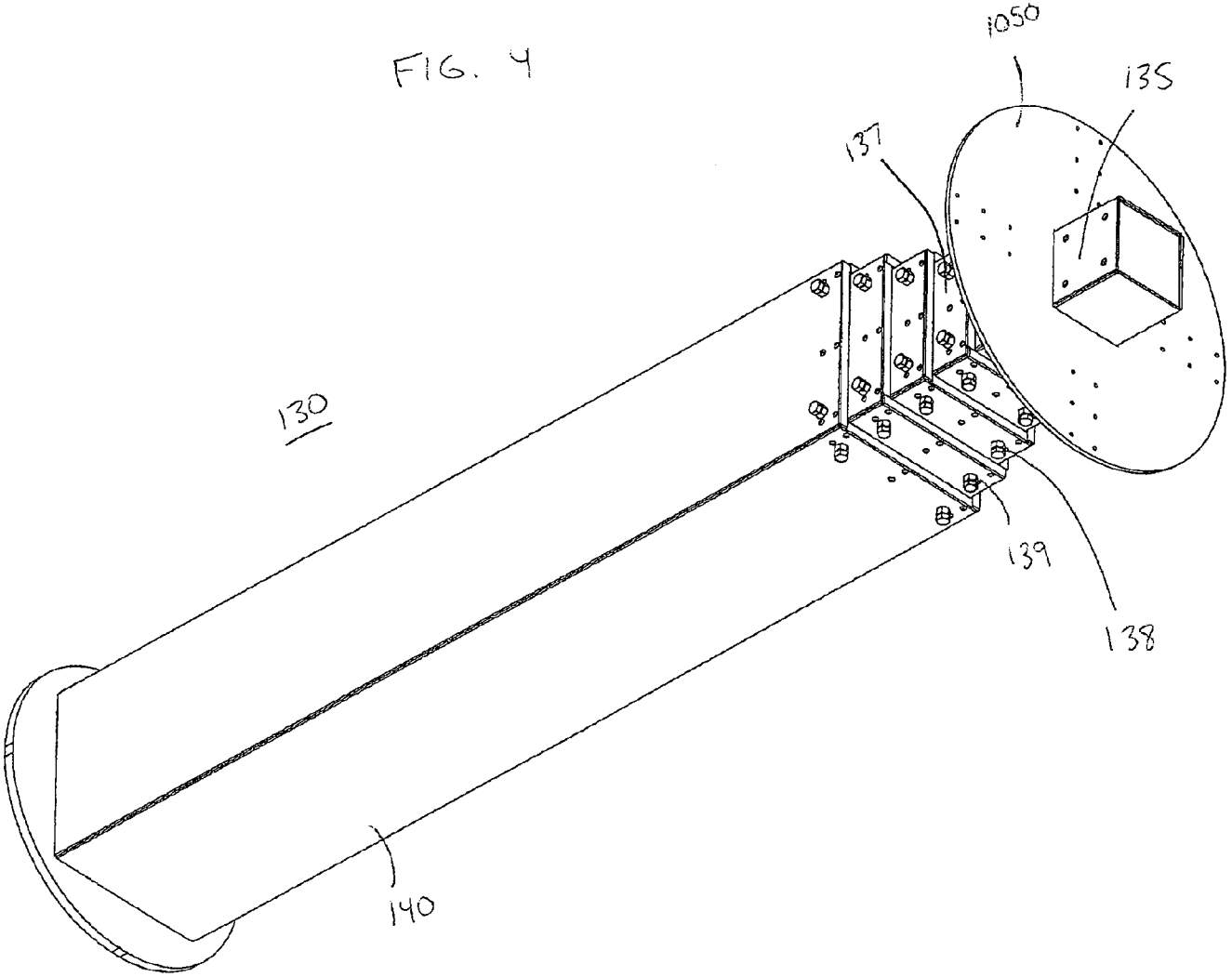
FIG. 4 is a three dimensional side view of a central support structure for use with the elevated platform of FIG. 1 and in accordance with the present invention.
Figure 5:
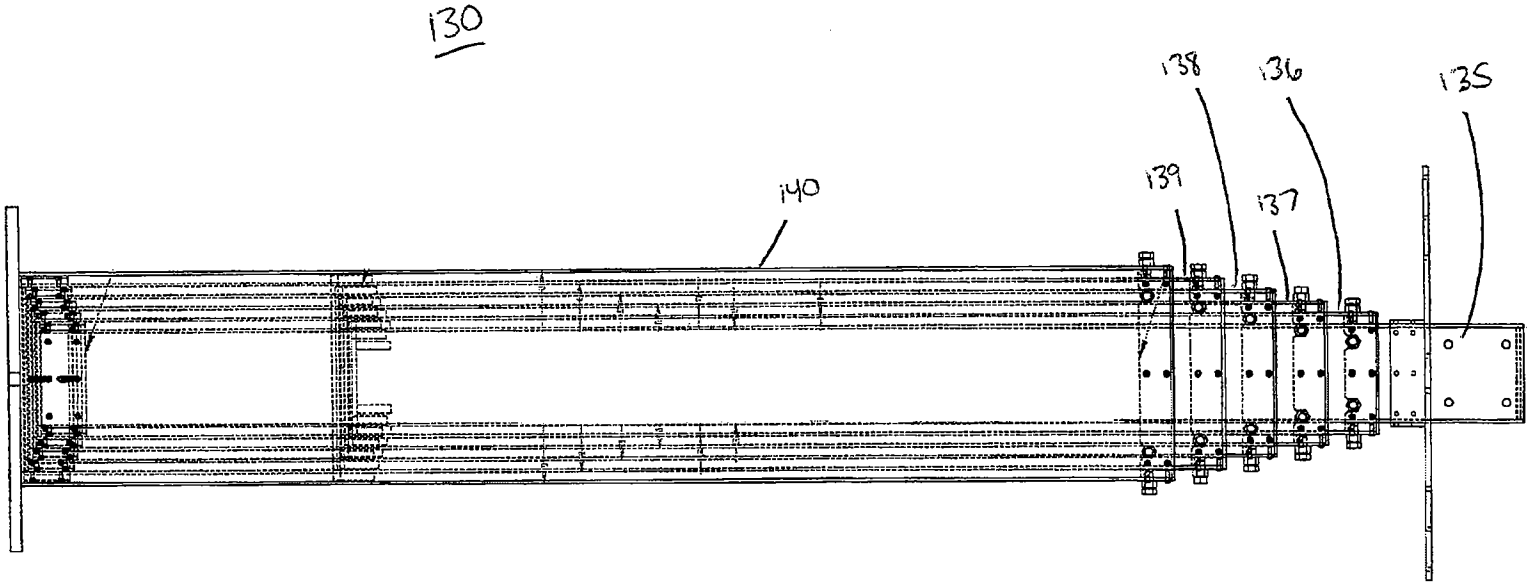
FIG. 5 is a cross-sectional side view of the central support structure of FIG. 4 for use with the elevated platform of FIG. 1 and in accordance with the present invention.

Referring now to the specific structure of the elevated platform 100 shown in FIGS. 1-3, the elevated platform 100 comprises a central support structure 130. As shown in FIGS. 1-3, the central support structure 130 may include tubes 135-140. FIG. 4 shows a three dimensional side view of the central support structure 130 with each of the tubes 135-140 interconnected in the deflated position. FIG. 5 shows a cross sectional side view of the central support structure 130 and tubes 135-140 of FIG. 4 in the deflated position. FIGS. 6A-F show three dimensional side views of each of the tubes 135-140 individually.

The central support structure 130 shown in FIGS. 1-6 has six poles 135-140. Alternatively, the central support structure 130 may have fewer or more tubes as desired. For example, the central support structure 130 may comprise a single tube or pole, or it may have ten or more individual tubes. In some embodiments, more tubes may be used to increase the maximum possible height of the elevated platform in the elevated position, or fewer tubes may be used to decrease the maximum possible height of the elevated platform. In other embodiments, the use of more or less tubes may not affect the maximum possible height of the elevated platform. In some embodiments, a greater number of poles, each with a shorter length, may be used such that when compacted together, the total length of the central support structure 130 is reduced. Embodiments such as these with more tubes each of relatively short lengths may be useful to decrease a depth at which a central support structure may be submerged in the ground. The central support structure 130 may operate, in whole, in part, or as a part of, a stabilizing element. The central support structure 130 may prevent, resist, or discourage lateral movement, side to side movement, swaying, rocking, or movement in directions other than up and down. In some embodiments regardless of the first direction and second direction which the elevated platform 100 is intended to operate, the central support structure 130 may resist movement in directions other than the first or second directions.

Tubes 135-140 may be stiff, rigid, hard, structurally solid, and/or generally unbending and may provide support for the elevated platform when the platform is in the elevated or raised position. The shafts of tubes 135-140 are preferably able to withstand force and pressure applied perpendicular to it, and in that manner withstand considerable swaying, side to side movement, or tipping. Tubes 135-140, and in particular the shafts of tubes 135-140 such as shaft 710 of tube 139 shown in FIGS. 7A-B, may be constructed of any rigid, stiff, hard, structurally solid, or other generally unbending materials or combination of materials, such as, for example, PVC, metal, plastic, wood, fiberglass, carbon fiber, aluminum, or any other similar materials. In a preferred embodiment, the shafts of tubes 135-140 may be constructed from carbon fiber or aluminum.

The shafts of tubes 135-140, such as shaft 710 of tube 139, are preferably generally hollow. The shafts of tubes 135-140 may have a thickness of between ⅛ inch and ½ inch throughout the majority of the shaft. At the lower end elements and top tube sections of tubes 135-140, such as lower end element 730 and upper tube section 760 of tube 139, the thickness may vary, as shown, for example, in FIGS. 7A-B. Most preferably, the thickness of the shaft throughout the majority of the shaft is ¼ inch. The tube may have the same general thickness throughout, or the thickness of the tube may vary. The shafts of each of the tubes 135-140 may each have the same thickness, or may be different thicknesses. Any combination of shafts and thicknesses is possible.

As shown in FIGS. 6A-F, central support structure 130 may generally have tubes of three distinct shapes, including a top tube 135, middle tubes 136-139, and bottom tube 140. Alternatively, the central support structure 130 may have fewer or more tube shapes. In preferred embodiments, the central support structure 130 has one top tube 135, one bottom tube 140, and one or more middle tubes 136-139. In alternative embodiments, some or all of the function and shapes of tubes 135-140 may be incorporated into more or less tubes. For example, in one embodiment, the central support structure 130 may have only one tube which incorporates the features of tubes 135-140 into it. Other variations are possible, including a central support structure 130 with only a top tube 135 and a bottom tube 140.

As shown in FIGS. 6A-F, the cross-sectional shaft size of each of the tubes 135-140 may vary. In some embodiments, such as the embodiments in FIGS. 1 and 2, top tube 135 may have the smallest cross-sectional shaft size, while each of tubes 136-140 gets progressively larger in cross-sectional shaft size. These embodiments may provide an advantage when securing the central support structure 130, such as through burying in the ground, in that the outer-most tube 140 which is secured has the largest cross-sectional shaft size, and all of the other tubes can movably fit inside the secured tube without also being fixed. Alternatively, any variation in tubes 135-140 and cross-sectional shaft sizes is possible.

As shown in FIGS. 6A-F, the cross-section shape of the shaft of each of the tubes 135-140 may be the same. For example, in the embodiments shown in FIGS. 1, 2, and 6A-F, the cross-sectional shape of tubes 135-140 is square. Alternatively, the cross-sectional shape of the tubes 135-140 may be any other shape, including circular, oval, rounded, rectangular, triangular, pentagonal, hexagonal, octagonal, or any other regular or irregular shape. Any combination of cross-sectional shapes and tubes may be possible. In preferred embodiments, each of the tubes 135-140 has a square cross-sectional shape.

As shown in FIGS. 6A-F, in some embodiments, the size of the cross-section of each of the tubes 135-140 is roughly uniform throughout the pole, except at the lower end elements, such as lower end element 1430 of tube 139. In other embodiments, the size of the cross-section of the tubes 135-140 may change throughout the length of the tube. Any variation in cross-sectional size or shape for any of the tubes 135-140 is possible. In preferred embodiments, the cross-sectional shape and size each of the tubes 135-140 remains the same throughout the length of the pole, except at the lower end elements where the cross-section is the same shape but larger in size than in the rest of the shaft. In more preferred embodiments, the shape of the cross section of the shaft 710 of tube 139 is square.

The cross-sectional shapes and sizes of tubes 135-140 may all be the same, or some or all of tubes 135-140 may have a different cross-sectional shape or size than the other tubes. In some preferred embodiment, tubes 135-140 each have a square cross-section with different dimensions. In some of these preferred embodiments, the outer cross-sectional length of the square sides of the tubes 135-140 is between 6 inches and 18 inches. In a more preferred embodiment, the outer cross-sectional length of one of the square sides of the tube 136 is about 10.5 inches; the outer cross-sectional length of one of the square sides of tube 137 is about 12.5 inches; the outer cross-sectional length of one of the square sides of tube 138 is about 14.5 inches; and the outer cross-sectional length of one of the square sides of tube 139 is about 16.5 inches. In some embodiments, this cross-sectional length may depend on the desired height.

Each of tubes 135-140 may have different lengths. In some embodiments, including those shown in FIGS. 6A-F, the top tube 135 may have the longest length while each of tubes 136-140 may be progressively shorter. In other embodiments, the tubes 135-140 may all be the same length. In other embodiments, some tubes are the same length and others are a different length. In preferred embodiments, the total length of each of the tubes 135-140 is between 6 feet and 9 feet. In the most preferred embodiments, the total length of tube 136 is about 9 feet 10 inches (9' 10"); the total length of tube 137 is about 9 feet 5.875 inches (9' 5.875"); the total length of tube 138 is about 9 feet 1.75 inches (9' 1.75"); and the total length of tube 139 is about 8 feet 9.625 inches (8' 9.625"). Any arrangement of tubes with the same or differing tube lengths is possible, and tube lengths may be considerably smaller or larger and may be created or manufactured at certain lengths depending on the maximum desired height for raising the elevated platform.

Referring again to the central support structure 130, and in particular to the middle tubes 136-139 shown in FIGS. 6B-E, each of the middle tubes 136-139 may all be generally constructed and shaped similarly to each other. Alternatively, some or all of the tubes 136-139 may have different shapes and constructions. For example, in some embodiments, some of the tubes may have a different cross-sectional shape, may include different features than a top portion and a base, or may be made from a different material than the other tubes.

Figure 6A:
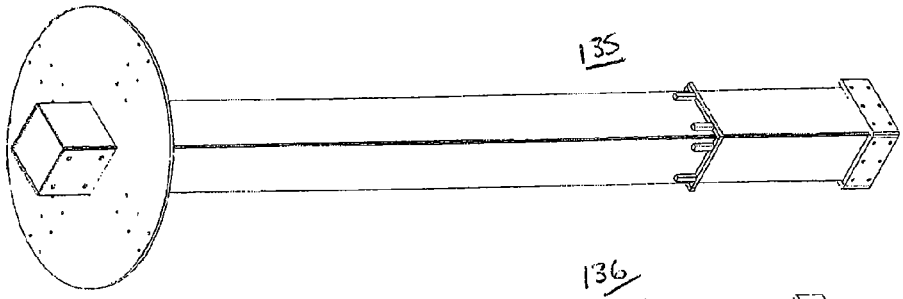
FIG. 6A is a three dimensional side view of a top tube of a central support structure for use with the elevated platform of FIG. 1 and in accordance with the present invention.
Figure 6B:
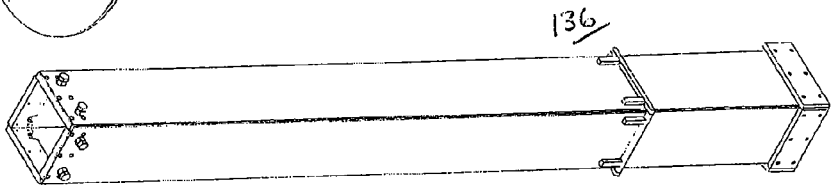
FIGS. 6B-E are three dimensional side views of four middle tubes of a central support structure for use with the elevated platform of FIG. 1 and in accordance with the present invention.
Figure 6C:
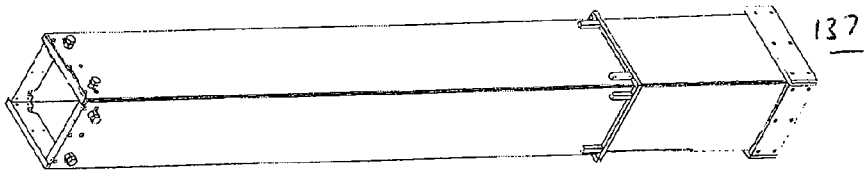
Figure 6D:
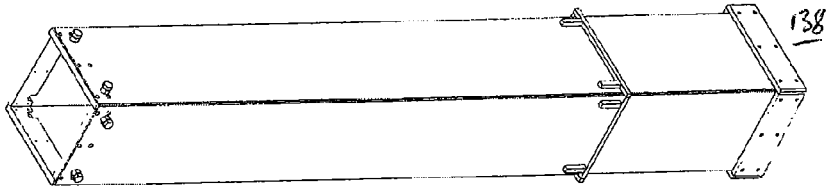
Figure 6E:
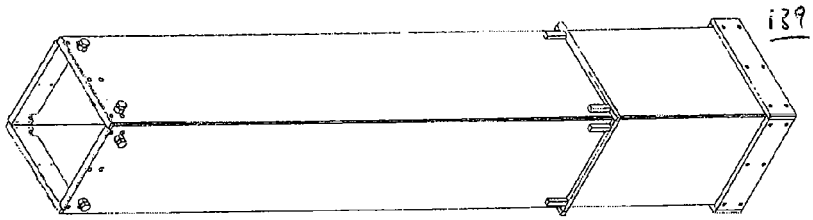
Figure 6F:
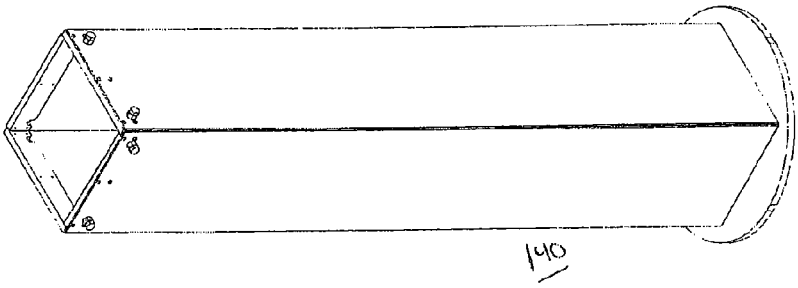
FIG. 6F is a three dimensional side view of a bottom tube of a central support structure for use with the elevated platform of FIG. 1 and in accordance with the present invention.
Figure 7A:
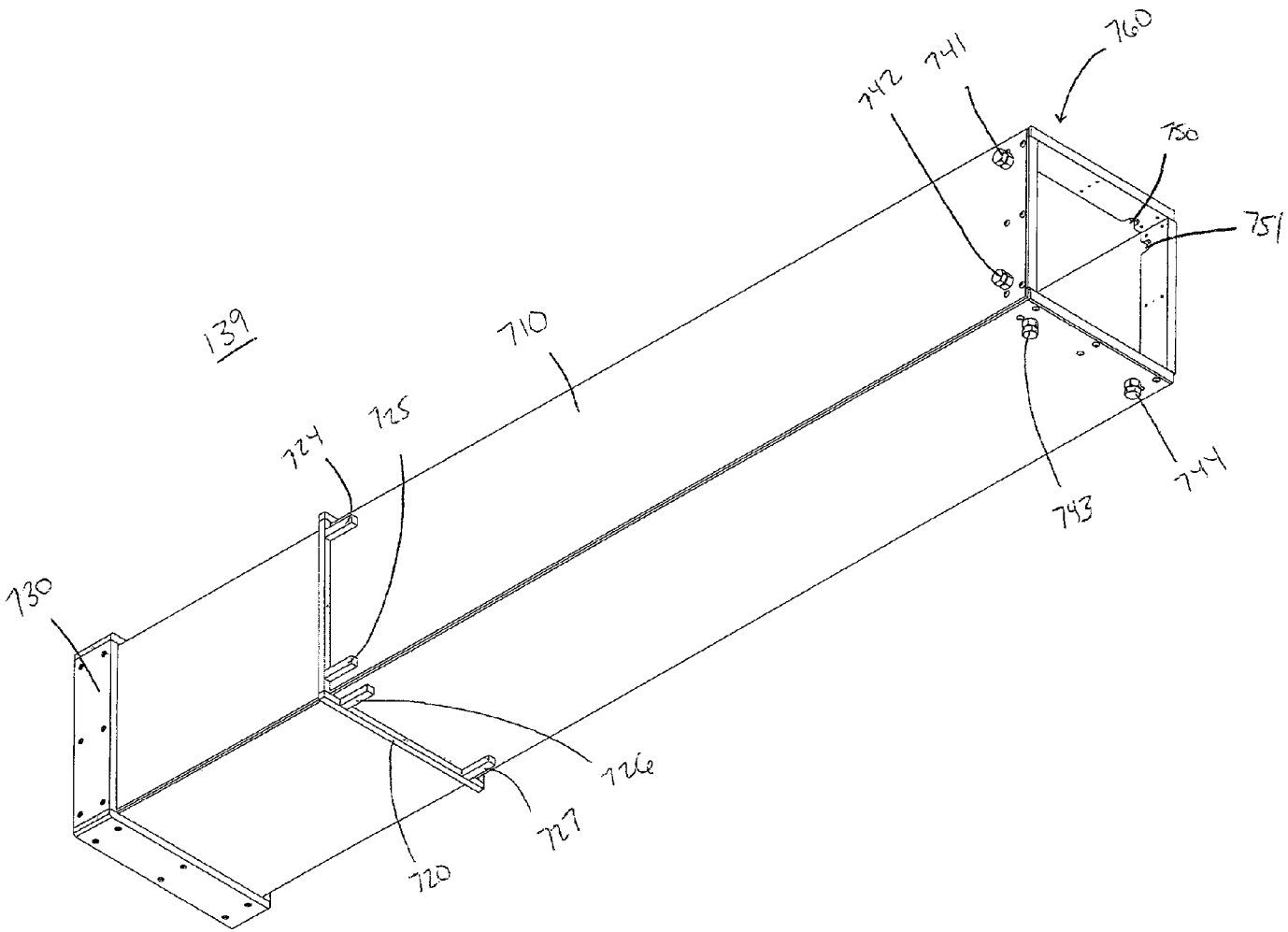
FIG. 7A is a three dimensional side view of a middle tube of a central support structure for use with the elevated platform of FIG. 1 and in accordance with the present invention.
Figure 7B:
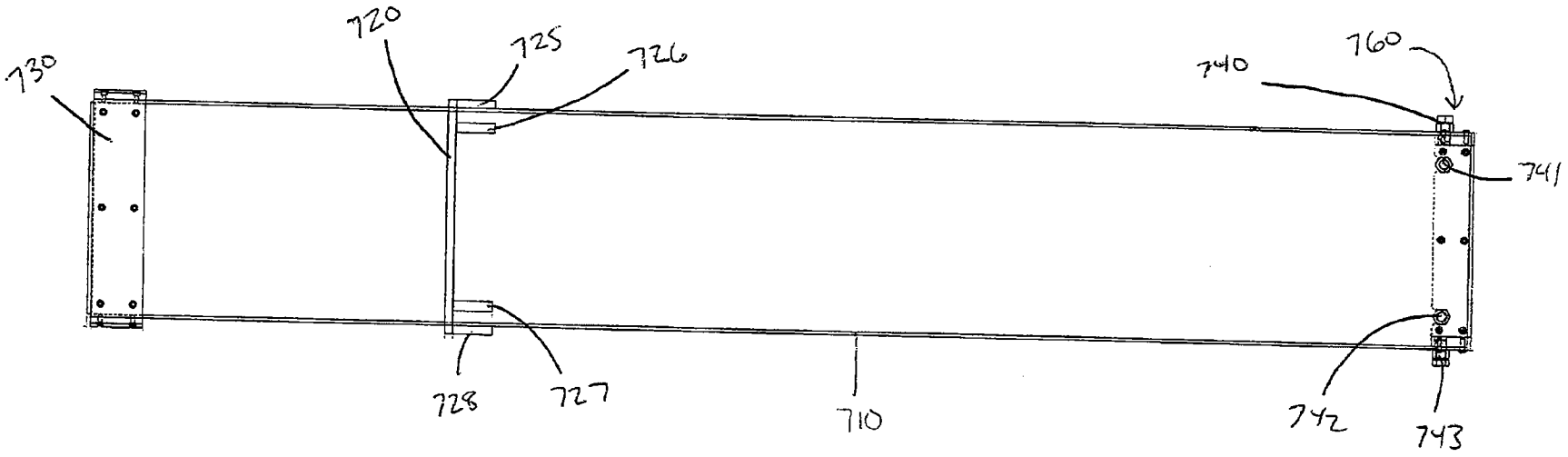
FIG. 7B is a cross-sectional side view of the middle tube of FIG. 7A for use with the elevated platform of FIG. 1 and in accordance with the present invention.

FIG. 7A shows an enlarged view of tube 139 from FIG. 6E. FIG. 7B shows a cross-sectional side view of the tube 139 from FIGS. 6E and 7A. For simplicity, the construction and operation of middle tubes 136-139 will be discussed with specific reference to tube 139 and FIGS. 7A-B, but it should be appreciated that tubes 136-138 may be constructed in the same or a similar manner. In some embodiments, the primary differences between tubes 136-139 may only be the cross-sectional size, the dimensions and placement of the components, and the length of the shaft.

As shown in FIGS. 7A-B, tube 139 may have a shaft 710, pulling element 720, lower end element 730, and upper tube section 760. The pulling element 720 may include tabs 724-728. The upper tube section 760 may have bolts 740-744. The upper tube section 760 may also include grooves 750-751 on the inside of the shaft 710. In some embodiments, some of these components may differ or not be necessary or present in tubes 136-139.

As mentioned above, the shaft 710 of tube 139 may be constructed of any rigid, stiff, hard, structurally solid, or other generally unbending materials or combination of materials, such as, for example, PVC, metal, plastic, wood, fiberglass, carbon fiber, aluminum, or any other similar materials or combination of materials. In a preferred embodiment, the shaft 710 of tubes 139 may be constructed from carbon fiber or aluminum.

The shaft 710 of tube 139 may have a cross-section of any shape and size, as described above. Preferably, the cross-section of tube 139 is square. The shaft 710 is preferably constructed so as to provide structural support for the elevated platform 100 in the elevated position.

Referring back to FIGS. 7A-B, tube 139 also includes lower end element 730. Lower end element 730 may be a piece of material connected to the exterior of the shaft 710 at the base of the shaft, and may be made of any hard, rigid, or still stiff material, such as, for example PVC, metal, plastic, wood, fiberglass, carbon fiber, aluminum, nylatron, or any other similar materials. In a preferred embodiment, the lower end element 730 is made of nylatron. Lower end element 730 may connected to the shaft 710 using any fastening, attaching, or connecting means, including using a nail, screw, bolt, nut, clip, fastener, glue, adhesive, tape, welding, soldering or any other fastening means. In a preferred embodiment, the lower end element 730 is bolted to the shaft. The lower end element 730 may operate to protect the tubes from being pulled all of the way out of the shafts below them.

Referring again to FIGS. 7A-B, the tubes 136-139 may have a pulling element 720. The pulling element 720 may also have tabs 724-728, as shown in FIGS. 7A-B.

Pulling element 720 may resemble a collar or protruding ring around the shaft 710 of the tube 139. In preferred embodiments such as those shown in FIGS. 7A-B, the pulling element 720 extends outward along the exterior of the shaft 710 along the across the side of each shaft 710, perpendicular to the direction of the openings of the shaft 710, and such that the pulling element generally forms an upraised square ring around the shaft 710. In some embodiments, pulling element 720 may extend outward from the exterior of shaft 710 along the entire width of each side of the shaft 710, in the manner shown in FIGS. 7A-B. Alternatively, the pulling element 720 may extend outward from the exterior of the shaft 710 along only some of the sides of the shaft 710, or along portions of the sides of shaft 710. The width of the pulling element 720 may be relatively small, such as, for example 2 inches wide.

In some other embodiments (not shown), pulling element 720 may simply be an extension of lower end element 730. In some of these embodiments, the external width of the shaft from the lower end element 730 to the pulling element 720 is uniform. In some embodiments, the pulling element 720 may be integrated into the lower end element 730. In preferred embodiments, the exterior cross section of the shaft 710 is wider at the pulling element 720 than at the upper tube portion 760 of the shaft 710.

The pulling element 720 may be made of a number of materials, including PVC, metal, plastic, wood, fiberglass, carbon fiber, aluminum, nylatron, or any other similar materials. In preferred embodiments, the pulling element 720 is made of nylatron. The pulling element 720 may be created separately from the shaft 710 of the tube 139, or may be created as part of the shaft 710 of the tube 139. In one embodiment, the shaft is created, molded, formed or manufactured such that the pulling element 720 is integrated with the shaft at the time of creation, molding, or manufacturing. In some embodiments, the pulling element is created, molded, formed, or manufactured separately from the shaft 710 and connected, attached, mounted, or combined at a later point. The pulling element 720 may be connected, attached to, or combined with the shaft 710 in any number of ways. Such later connections, attachments, or combinations may be facilitated or result from the use of any fastening, attaching, or connecting means, including using a nail, screw, bolt, nut, clip, fastener, glue, adhesive, tape, soldering, welding, or any other fastening means. In preferred embodiments, the pulling element 720 is created separately from the shaft 710 and is bolted to the shaft 710.

The pulling element 720 may include tabs 724-728. The tube 139 shown in FIGS. 7A-B includes eight tabs, with two tabs connected, attached, mounted, or combined with each side of the shaft 710 as shown. More or less tabs may be used, and different configurations may be implemented as desired. Preferably, the number of tabs for each pulling element 720 will match the number of grooves 751 of the next largest tube. For example, preferably the number of tabs for tube 137 will match the number of grooves in tube 138.

In some preferred embodiments, tabs 724-728 may be generally parallel with the length of the shaft 710 and perpendicular to the main ring- or collar-shaped portion of the pulling element 720. Tabs 724-728 may alternatively be configured in any other way.

Tabs 724-728 may be made of a number of materials, including PVC, metal, plastic, wood, fiberglass, carbon fiber, aluminum, nylatron or any other similar materials or combination of materials. In preferred embodiments, the tabs 724-728 are made of nylatron.

Tabs 724-728 may be connected, attached to, or combined with the shaft 710 in any number of ways. In one embodiment, the shaft is created, molded, formed, or manufactured such that the tabs 724-728 are integrated with the shaft at the time of creation, molding, forming, or manufacturing. In some embodiments, the pulling element 720 is created, molded, formed or manufactured such that the tabs 724-728 are integrated with the pulling element 720 at the time of creation, molding, forming, or manufacturing. In some embodiments, the tabs 724-728 are created separately from either or both of the shaft 710 and pulling element 720 and connected, attached, or combined at a later point. Such later connections, attachments, or combinations may be facilitated or result from the use of any fastening, attaching, or connecting means, including using a nail, screw, bolt, nut, clip, fastener, glue, adhesive, tape, soldering, welding, or any other fastening means. In preferred embodiments, the tabs are bolted to the shaft 710.

Referring back to FIGS. 7A-B, upper tube section 760 of tube 139 may also include grooves 750 and 751 on the inside of shaft 710. In some embodiments, including that shown in FIG. 7A, the upper tube section 760 may have two grooves on each of the interior sides of the shaft 710. More or less grooves may be used. As mentioned, preferably the number of grooves for a tube will match the number of tabs for each pulling element 720 of the next smallest tube. For example, preferably the number of tabs for tube 137 will match the number of grooves in tube 138.

Figure 8:
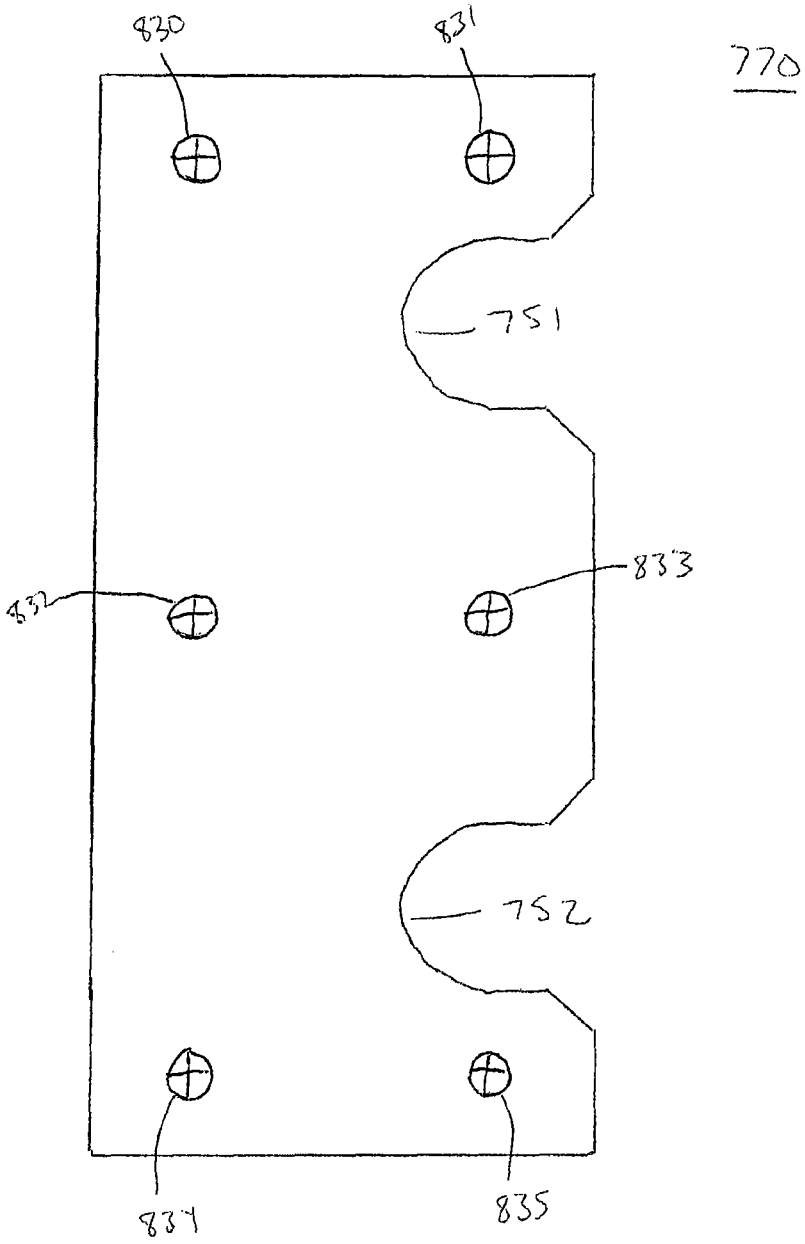
FIG. 8 is a top view of a groove piece for use with a tube of a central support structure for use with the elevated platform of FIG. 1 and in accordance with the present invention.

The grooves 750-751 may be formed in any number of ways. In embodiments such as that shown in FIGS. 7A-B, one or more groove pieces 770 and 780 may be connected, attached to, or combined with the interior of the shaft 710 at the top portion of the tube 139. FIG. 8 shows an example of a groove piece 770, which has two grooves 751 and 752. Alternatively, the grooves may be cut directly into the shaft 710 or constructed in any number of known ways.

Fewer or more groove pieces may be attached to an upper tube section 760 of a tube 139, and the number of groove pieces may depend on the size or shape of the shaft 710 of tube 139. Where the shaft 710 is circular, oval, or rounded, similar methods of providing such grooves may be used, including using rounded, half-cylindrical, or quarter-cylindrical groove pieces attached to the inside of the shaft 710 at the upper tube section 760 in a similar manner. Groove pieces 770 and 780 may be made from any hard, rigid, or still stiff material, such as, for example PVC, metal, plastic, wood, fiberglass, carbon fiber, aluminum, or any other similar materials.

As shown in FIG. 8, two grooves may be created in one groove piece 770. More or less grooves may be created using each groove piece 770. The grooves may be created through any known means prior to, during, or after connecting the groove piece 770 to the shaft 710. In some embodiments, no groove pieces are used or needed, as the grooves may not be necessary or may be formed another means.

The groove pieces 770 and 780 may be connected, attached to, or combined with the shaft 710 using any fastening, attaching, or connecting means, including using a nail, screw, bolt, nut, clip, fastener, glue, adhesive, tape, soldering, welding, or any other fastening means. In some embodiments, such as those shown in FIGS. 7A-B and 8, a fastening means such as a screw or a nut and bolt may be inserted through the holes 830-835 shown in groove piece 770 and similar holes found at the top portion of shaft 710. In other embodiments, the grooves 751 and 752 and/or groove pieces 770 and 780 are formed as part of the shaft 710 of the tube 139 when the shaft 710 is created. In a preferred embodiment, the groove pieces are screwed, bolted, and/or glued to the shaft.

In any embodiment of a shaft 710, grooves 750 and 751 may facilitate the expansion of the central support structure 130 by interlocking, engaging, or connecting with the tabs of pulling elements of tubes with smaller cross-sectional sizes when the central support structure 130 is expanding.

For example, in an embodiment where the bladder section 108 is being inflated, bladder section 108 may exert a force on the bottom of platform 105 and/or top plate 1050 of tube 135. When this force is great enough, the platform 105 and/or the tube 135 may be pushed upwards. During the movement of tube 135 upwards, the shaft of tube 135 may slide through the interior of the shaft of tube 136, since the exterior dimensions of tube 135, including the exterior dimensions at the pulling element of tube 135, may be smaller than the interior dimensions of tube 136. However, because the dimensions of the pulling element of tube 135 are wider than the rest of the shaft of tube 135, and because the interior dimensions of the shaft of tube 136 are smaller at the upper tube section of tube 136, when the pulling element of tube 135 reaches the upper tube section of tube 136, tube 135 is no longer able to move upward unimpeded. Instead, the pulling element of tube 135 hits or is impeded by the upper tube section of tube 136. In a preferred embodiment, the tabs of the pulling element of 135 are aligned with the grooves of tube 136, so that when tube 135 has extended to the point that the pulling element of tube 135 is adjacent to the upper tube section of tube 136, the tabs of tube 135 engage, connect with, interlock with, or otherwise attach or touch to the grooves in tube 136. As more force is applied to the bottom of platform 105 and/or top plate 1050 of tube 135, some of this force is transferred via the interlocked or touching pulling element of tube 135 and grooves of tube 136, such that tube 135 exerts a pulling force on tube 136 in the upward direction. When the force on the bottom of platform 105 and/or top plate 1050 of tube 135 is great enough that a sufficient force is transferred to the grooves of tube 136, both tubes 135 and 136 will move upward. A similar interlocking or engaging action occurs again when the pulling element of tube 136 hits or is next to the upper tube section of tube 137, with the interlocking or engaging action occurring between tubes 136 and 137. The same or similar actions are repeated with tubes 138 and 139 as the central support structure 130 continues to expand.

The engagement of the tabs with the grooves may be advantageous over simply having the pulling element engage a lip of the top portion of a pole, in that the tabs and grooves may provide lateral stability. For example, the tabs and grooves may resist movement sideways or a twisting of the tubes. The tabs and grooves may be particularly useful when tubes with a circular cross-section are used, as the tabs and grooves may resist the rotation and twisting of the tubes.

Alternatively, in some embodiments, no tabs and grooves are used. In some embodiments, the central support structure 130 may expand because each of the tubes 135-139 may have a pulling element, while each of the larger tubes 136-140 may have an upper portion which has a thicker shaft and a smaller interior cross-sectional area. When the pulling element of each of tubes 135-139 connects, hits, or comes next to the thicker lip on each tube with a larger shaft, a force similar to that described above is exerted on the thicker lip, as opposed to the grooves described above, and when the force is sufficient, the tube with the thicker lip is lifted in a manner similar to that described above.

In other embodiments, the thickness or dimensions of the tubes may change along the shafts of the tubes. For example, each of tubes 135-140 may comprise a frustoconical cross sectional shape. In these embodiments, the top tube 135 may have a smaller cross-sectional diameter at the upper portion of top tube 135, and may have a larger cross-sectional diameter at the lower end element. The next tube 136 may have an upper cross-section diameter that is larger than the upper cross-sectional diameter of tube 135, but smaller than the bottom cross-sectional diameter of tube 135. In this way, at some point as tube 135 moves upward with forces exerted by an expanding bladder structure 108, at some point the cross-sectional diameter of the top tube 135 passing through the opening at the top of tube 136 will be nearly equal to, or equal to, the cross-sectional diameter of the upper portion of tube 136, such that tube 135 cannot extend further out of tube 136. At this point, some of the force used to push tube 135 upwards is transferred to tube 136, and in a manner similar to that described above, when the pressure pushing up tube 135 is great enough, tube 136 begins to move upward as well. This may proceed until the cross section of tube 136 that has moved out of tube 137 is nearly or equal to the cross section of the top portion of tube 137.

In the embodiments shown in FIGS. 7A-B, the upper tube section 760 may include stoppers 740-744. Stoppers 740-744 may extend beyond the width of the shaft 710 of the tube 139. These stoppers 740-744 may be wider than the interior width of the shafts of the tube larger than tube 139, namely tube 140, so that when tube 139 sits in tube 140, the stoppers 740-744 prevent tube 139 from becoming completely enveloped, encased, encompassed, or covered by tube 140. In tube 139, eight stoppers, two on each of the four sides of the shaft 710, are found. More or less stoppers may be used.

Figure 10A:
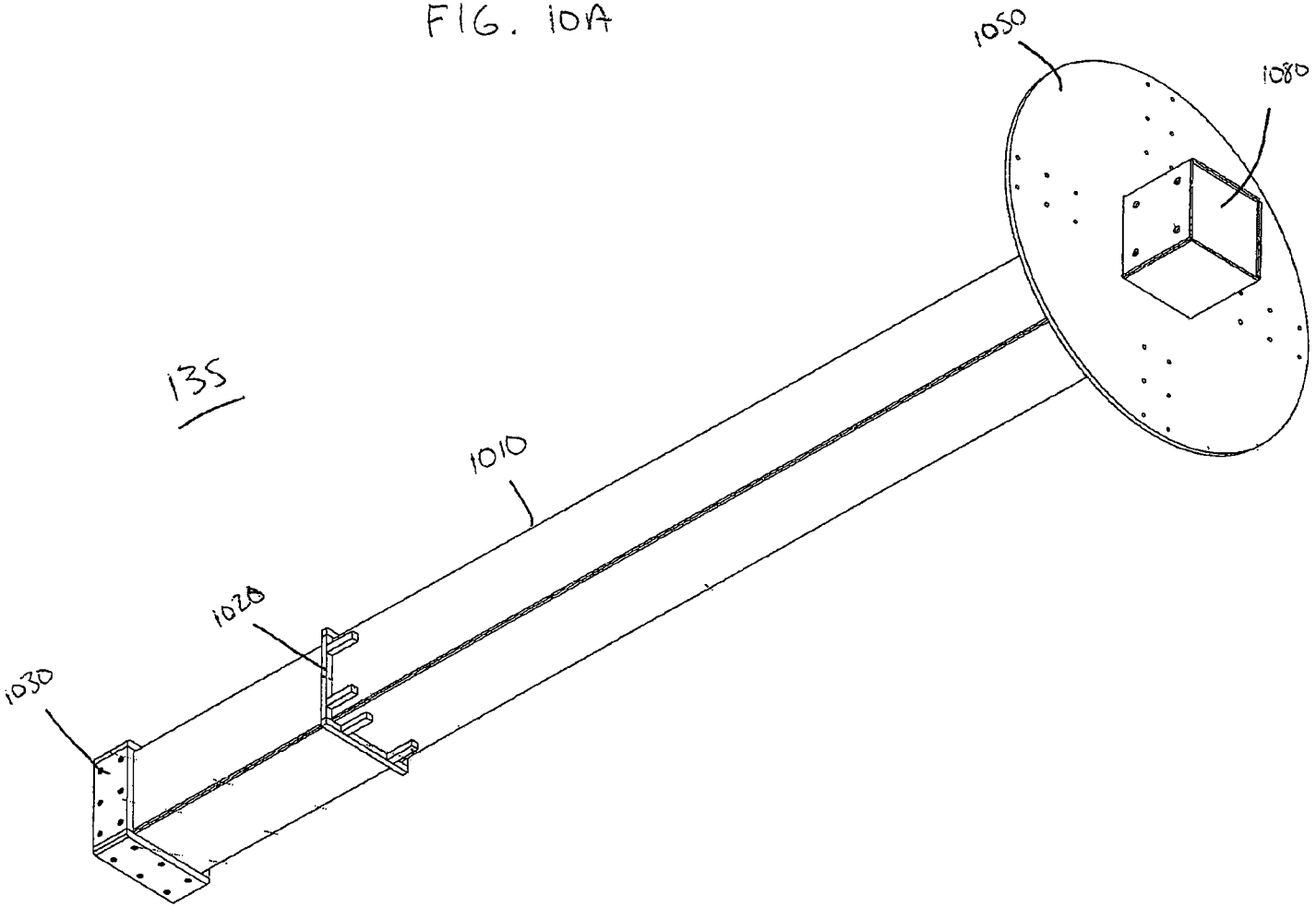
FIG. 10A is a three dimensional side view of a top tube of a central support structure for use with the elevated platform of FIG. 1 and in accordance with the present invention.
Figure 10B:
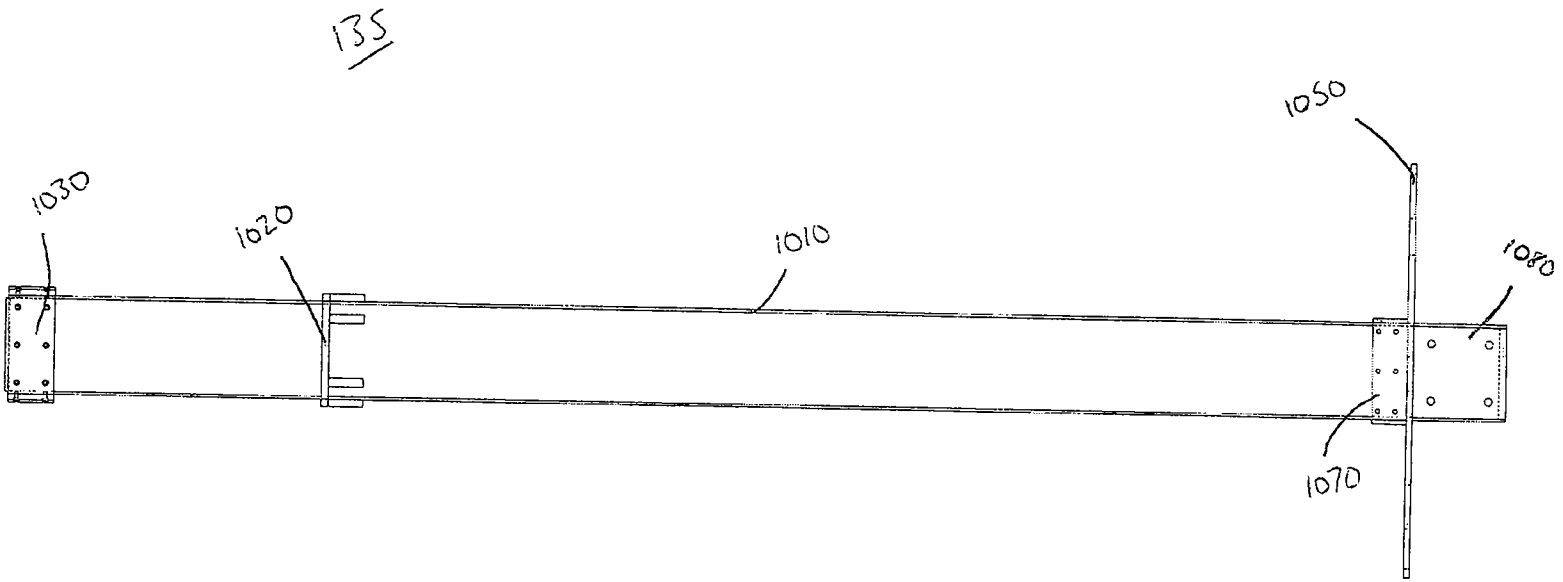
FIG. 10B is a cross-sectional side view of the top tube of FIG. 10A for use with the elevated platform of FIG. 1 and in accordance with the present invention.

Referring back to FIGS. 1-6, the central support structure 130 may have a top tube 135. FIG. 10A shows a three dimensional side view of top tube 135. FIG. 10B shows a cross-sectional side view of the top tube 135, which includes a lower end element 1030, a shaft 1010, a pulling element 1020, a top plate 1050, and a plate holding piece 1070. The shaft 1010, pulling element 1020 and lower end element 1030 of top tube 135 may be created and operate in the same or a similar manner as the shaft 710, pulling element 720 and lower end element 1430 of tube 139. However, top tube 135 may not have any bolts, grooves, or groove pieces like tube 139. These may not be necessary, because top tube 135 may be the first tube of the central support structure 130 to move from the compacted position to an expanded position when the bladder structure 108 is inflated.

Figure 11:
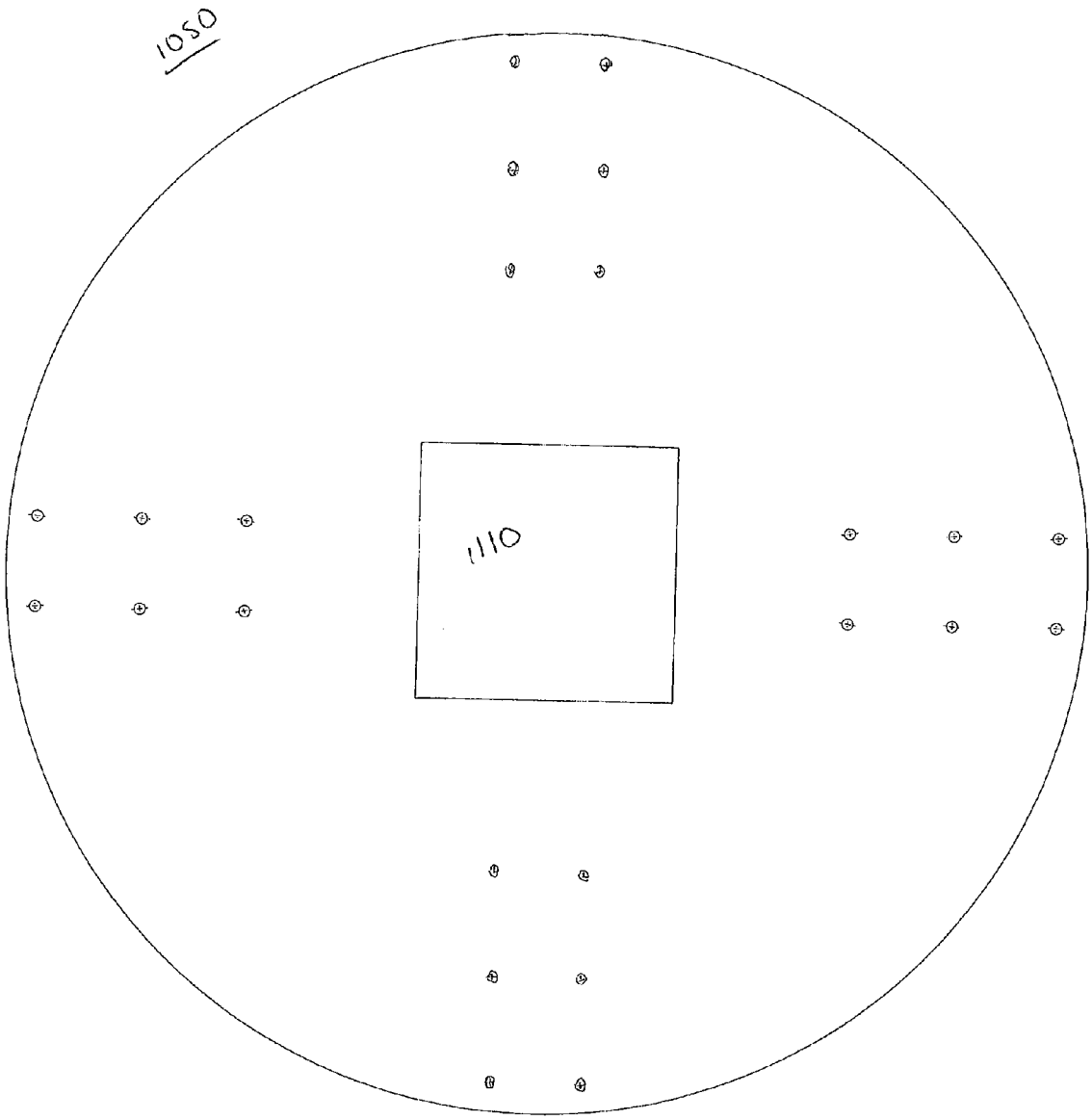
FIG. 11 is a top view of a top plate of a central support structure for use with the elevated platform of FIG. 1 and in accordance with the present invention.
Figure 17A:
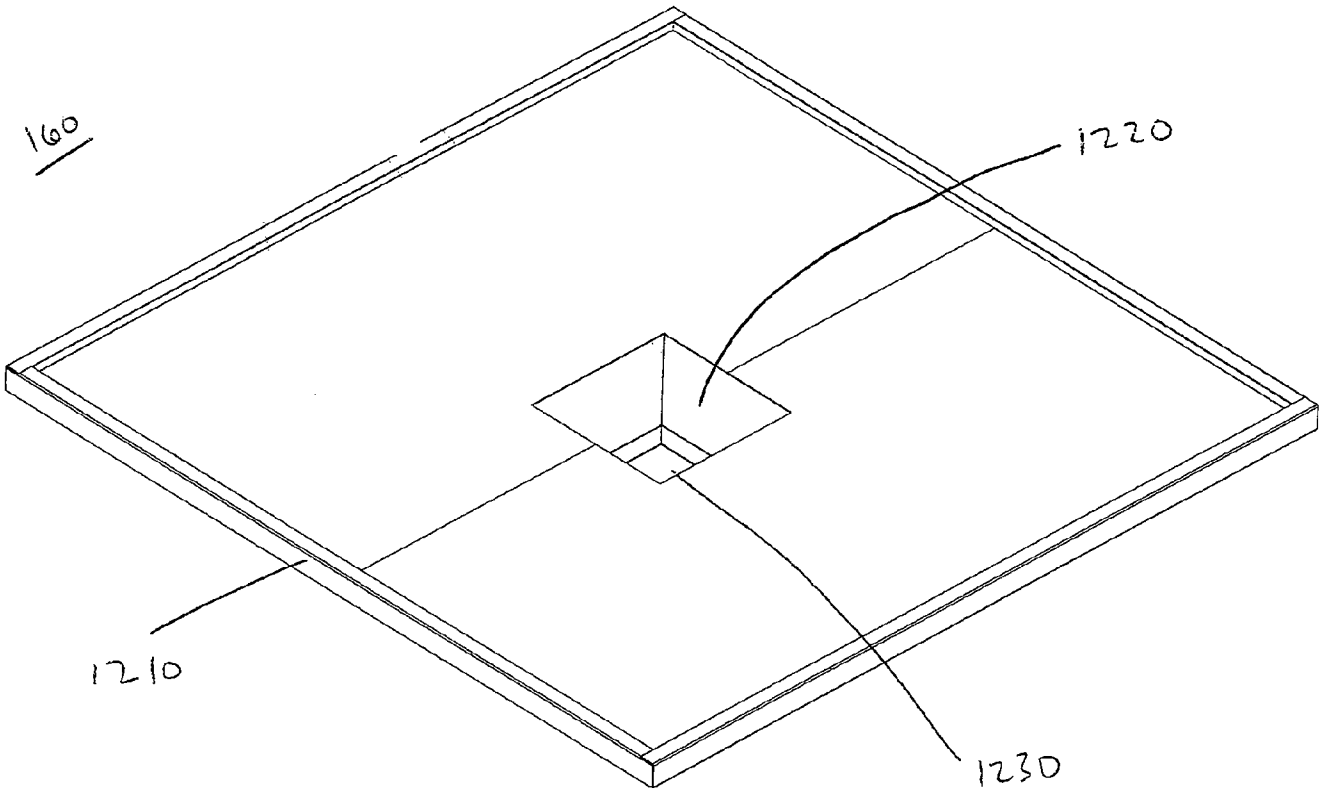
FIG. 17 is a transparent elevated side view of a second embodiment of a bladder cushion for use with the elevated platform of FIG. 1 and in accordance with the present invention.

Top tube 135 may include top plate 1050. FIG. 11 shows one embodiment of top plate 1050. Top plate 1050 may be circular as shown in FIGS. 10-11. Alternatively, top plate 1050 may be any other shape, including rectangular, square, triangular, pentagonal, hexagonal, octagonal, rounded, or oval shaped. In preferred embodiments, the platform may be circular with a diameter of 3 feet.

Top plate 1050 may be made of any hard, stiff, rigid, or generally unbending material, including any of the materials or combination of materials which may be used to make the shafts 710, 910, and 1010, including PVC, metal, plastic, wood, fiberglass, steel, carbon fiber, aluminum, or any other similar materials or combination of materials. Preferably, the top plate is made of steel.

Top plate 1050 may have any thickness and is preferably able to support the weight of the platform 105 as well as a plurality of users and other cargo. Preferably, the top plate 1050 is ½ inch thick steel.

Top plate 1050 may be made or constructed when the shaft and rest of tube 135 are constructed, such that the top plate 1050 is part of and not independent from the tube 135. In preferred embodiments, top plate 1050 is constructed independently of tube 135 and attached to tube 135.

As described below, the bladder structure 108 may be attached to the bottom of the top plate 1050. This may be useful so that as the bladder structure 108 inflated or rises, the top plate 1050 is pushed upwards by the expanding bladder structure 108. As top plate 1050 is pushed upwards, top tube 135 is pulled outward from the central support structure 130 and in particular, the next middle tube 136.

As shown in FIG. 11, top plate 1050 may have an open area 1110, though this is not required in some embodiments, including those embodiments where the top plate 1050 is created as an immovable part of the tube 135. The open area 1110 may be the same size as, or slightly larger than, the cross section of top tube 135. The open area 1110 may alternatively be any size or shape. In a preferred embodiment, the open area 1110 is the same shape as, and slightly larger than, the cross section of the shaft 1010 top tube 135.

As shown in FIG. 10B, top tube 135 may also include plate holding piece 1070. In the embodiment shown in FIG. 10A-B, the top tube 135 may have four plate holding pieces, with each one attached on one side of the shaft 1010 and forming an extended ring or band around the shaft 1010. More or less plate holding pieces may be used as desired or necessary, and the use or more or less plate holding pieces may depend on the shape, size, and number of sides of the shaft 1010. These plate holding pieces may be connected to the tube 135 in any manner. Preferably, these are welded to the shaft.

This ring or band formed by the four plate holding pieces preferably extends along the entire circumference of the shaft 1010, and preferably extends the cross-sectional size of the shaft 1010 to a size larger than that of the open area 2010. In such embodiments, the top plate 1050 may be inserted through the top portion of top tube 135 and may slide down the shaft 1010 of top tube 135 until it reaches the plate holding piece 1070. In these embodiments, the top plate 1050 may rest at least partially on a side of the plate holding piece 1070. Preferably, top plate 1050 is additionally or alternatively immovably connected to the shaft 1010 of the top tube 135 in any manner. In a preferred embodiment, the top plate 1050 is welded to the top tube 135 and the plate holding pieces. In preferred embodiments, the top plate 1050 forms an air-tight seal with the top tube 135, so that when the bladder structure 108 is connected to the bottom of the top plate 1050, no air escapes.

Referring back to FIGS. 1-3, the elevated platform 100 may also include a platform 105. In some embodiments, platform 105 may be on top of the central support structure 130 and/or the bladder structure 108. In some preferred embodiments, platform 105 may be attached or connected to the top plate 1050 of the top tube 135 of the central support structure 130 in any number of ways, including using screws, nuts, or bolts, or welding, soldering, gluing, fastening, and/or any other method of attachment. Preferably, the platform 105 is bolted to the top plate 1050.

In some embodiments, the platform 105 may be constructed so that the protruding (top portion 1080 of tube 135 may fit or interconnect with the platform 105 to prevent side to side or lateral movement of the platform 105 and to provide extra stability and support for the platform 105. In other embodiments, the platform 105 may simply rest on top of top plate 1050 of tube 130. In other embodiments, the platform 105 may not be connected at all, or may partially be connected, to the central support structure 130.

The platform 105 may extend horizontally beyond the edge of top plate 1050. In preferred embodiments, the weight or structure placed on top of top plate 1050 is evenly, or close to evenly, distributed on all parts of the top plate 1050. In preferred embodiments, the top plate 1050 will be in roughly the geographic center of any platform or weights placed on top of it.

Platforms may be in any number of forms. For example, as shown in FIGS. 1-3, the platform 105 may be a wooden deck. In other embodiments, the platform may be made of fiberglass, steel, metal, aluminum, glass, plastic, wood, concrete, or any other material of sufficient strength to support a user or cargo.

Platform 105 may be of sufficient structural strength to support cargo, passengers, or other users which may be a person, an animal, a machine, or anything else that may use or require the use of the platform 105. For example, platform 105 may be large enough and strong enough to support between 15,000 lbs and 25,000 lbs.

Platform 105 may generally function as a platform, area, or surface on which users or cargo may be placed. The platform 105 may have a square surface, a circular surface, or a surface of any other shape or combination of shapes. In some embodiments, the platform 105 has a large enough area so that a plurality of people may stand or sit on the platform 105, and may be large enough and strong enough to additionally support cargo such as chairs and a table along with the plurality of people. In preferred embodiments, the platform has a square surface which is ten feet wide and ten feet long. In preferred embodiments, the platform 105 has roughly the same surface dimensions as the cross-sectional dimensions of the bladder structure 108 in the inflated position.

Platform 105 may move from the deflated position to an elevated position, or any position higher than the deflated position, through the use of the bladder structure 108. The bladder structure 108 may be inflated as discussed, such that the inflated bladder structure 108 may exert an upward force on the bottom of platform 105 and/or the bottom of top plate 1050 which may be connected to the platform 105. The force from the bladder structure 108 may cause the bladder structure 108 to continue to expand, thereby moving the platform 105 and/or the top tube 135 of the central support structure 130 in the upward direction. Platform 105 may move from an elevated position to a more deflated position by allowing some of the gas which is used to inflate the bladder structure 108 to be removed, such that the bladder structure 108 shrinks or reduces in size.

Figure 9A:
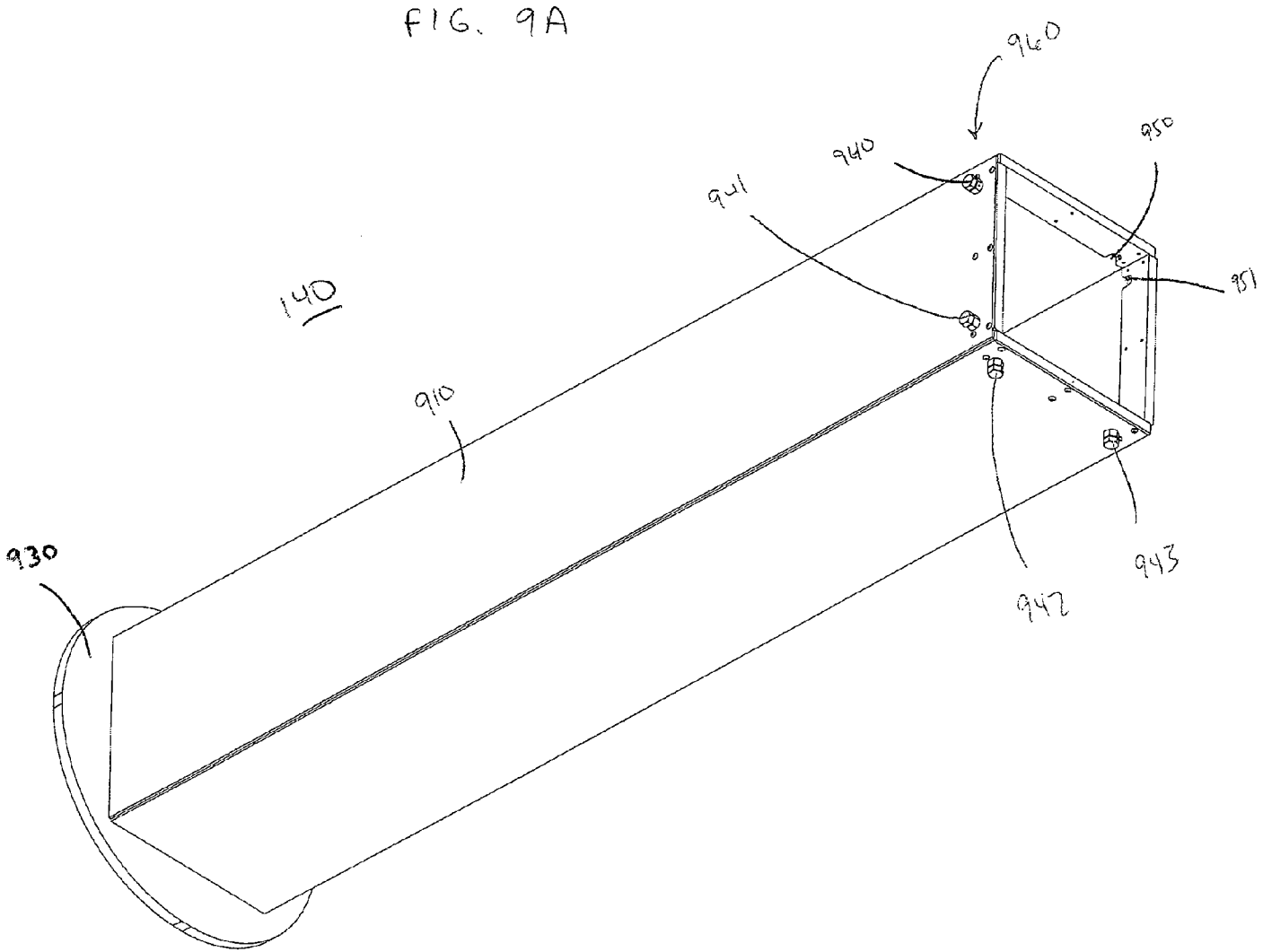
FIG. 9A is a three dimensional side view of a bottom tube of a central support structure for use with the elevated platform of FIG. 1 and in accordance with the present invention.
Figure 9B:
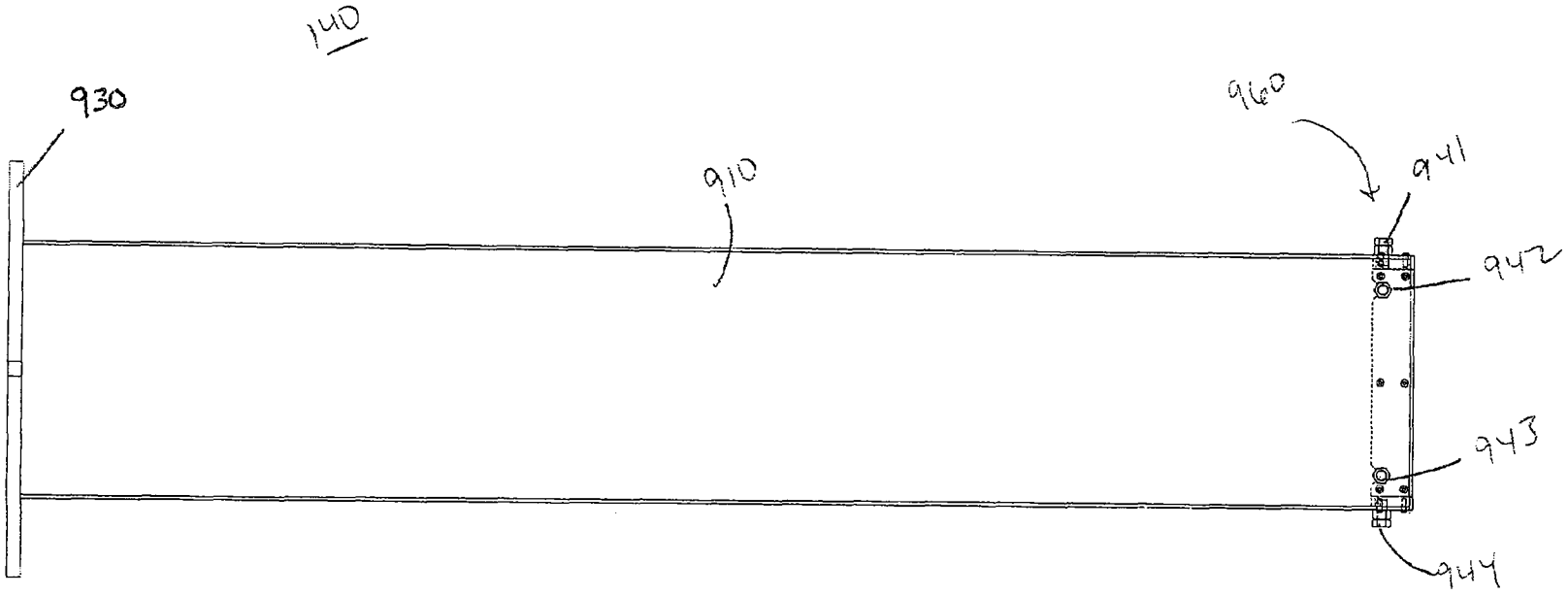
FIG. 9B is a cross-sectional side view of the bottom tube of FIG. 9A for use with the elevated platform of FIG. 1 and in accordance with the present invention.

Referring back to FIGS. 1-6, the central support structure 130 also has a bottom tube 140. FIG. 9A shows a three dimensional side view of bottom tube 140 of FIG. 6F, which includes a base element 930, a shaft 910, and an upper tube section 960 with bolts 940-944 and grooves 950-951. FIG. 9B shows a cross-sectional side view of the tube 140 from FIGS. 6F and 9A. The shaft 910 and upper tube section 960 of bottom tube 140 may be created and operate in the same or a similar manner as the shaft 710 and upper tube section 760 of tube 139 described above. However, bottom tube 140 may not have a pulling element like tube 139, as bottom tube 140 may not be operable to move upward when a force in the upward direction is applied to the bottom tube 140, and because bottom tube 140 does not have a larger tube below it to pull upwards. Additionally, the base element 930 in tube 140 may be different than the lower end element 730 in tube 139, because the base element 930 of tube 140 may preferably be buried in the ground. Base element 930 may be configured to resist upward movement when buried and provide resistance or support when the other tubes 135-139 have been fully expanded.

Base element 930 of tube 140 may be attached to an end of the shaft 910 opposite the upper tube section 960 of tube 140. Base element 930 may be made of any rigid, stiff, hard, structurally solid, or other generally unbending materials or combination of materials, including, for example, PVC, metal, plastic, wood, fiberglass, carbon fiber, aluminum, or any other similar materials. In a preferred embodiment, the shafts of tubes 135-140 may be constructed from carbon fiber or aluminum. In a preferred embodiment, the base element 930 is made of carbon fiber, steel, or alumimum. Base element 930 may be any shape, including circular, oval, round, square, rectangular, triangular, pentagonal, hexagonal, octagonal, or any other shape. Base element 930 may be any size, and in a preferred embodiment, is larger than the cross section of the shaft 910. Base element 930 may have any thickness, and preferably has a thickness of approximately one inch. In one preferred embodiment, the base element 930 is circular with a diameter of 30 inches. In another embodiment, the base element 930 is square with a thickness of 1 inch.

Base element 930 may be attached to the shaft 910 in any number of normal fastening ways, including using a nail, screw, bolt, nut, clip, fastener, glue, adhesive, tape, soldering, welding, or any other fastening means. In a preferred embodiment, the base element 930 is welded to the shaft 910 to form an air-tight seal. This may prevent water, dirt, and other unwanted objects from entering the central support structure 130. In other embodiments, the lower end element is created, constructed, or molded as part of the shaft 910 when the shaft 910 is created.

As shown in FIGS. 1 and 2, a portion of the central support structure 130 may be buried in the ground or surrounded by a sufficiently strong material or substance so as to resist movement. For example, a portion of the central support structure 130 may be placed in a hole in the ground, and/or may be surrounded by compacted dirt, concrete, rocks, or otherwise. In the embodiment shown in FIG. 2, this portion of the central support structure 130 comprises the bottom tube 140. Alternatively, in other embodiments, central support structure 130 may be bound, secured, or attached to a solid, rigid, or unmoving object such as a house, hill, building, rock, or other sturdy and generally unmoving object. In preferred embodiments, a lower section of bottom tube 140 of central support structure 130 is secured so that central support structure 130 cannot easily move, tip, or sway from side to side in the elevated position. In more preferred embodiments, the lower portion of bottom tube 140 of the central support structure 130 is buried into the ground. In preferred embodiments, no tube other than bottom tube 140 is fixedly attached or buried.

Bottom tube 140 may be secured or buried so as to provide stability for the elevated platform 100. Base element 930 may be the bottom-most component in the central support structure 130 and/or the elevated platform 100. In preferred embodiments, the base element 930 is wider than the shaft 910 of the bottom tube 140, and is secured such that the central support structure 130 cannot be easily removed. In preferred embodiments, the function of the base element 930 is to resist any upward movement or upward or lateral force on the bottom tube 140.

Preferably, bottom tube 140 is preferably nearly immovable or unbending. Preferably, nearly all of bottom tube 140 is buried or secured underground. In preferred embodiments, when all of the tubes are in the compacted position shown in FIGS. 2 and 4-5, a large portion of each of tubes 135-139 may reside inside each other, and nearly all of these tubes may additionally lie or exist inside the shaft 910 of tube 140. In preferred embodiments, the bottom tube 140 is stationary and does not move when the elevated platform 100 is being inflated or deflated.

Figure 12B:
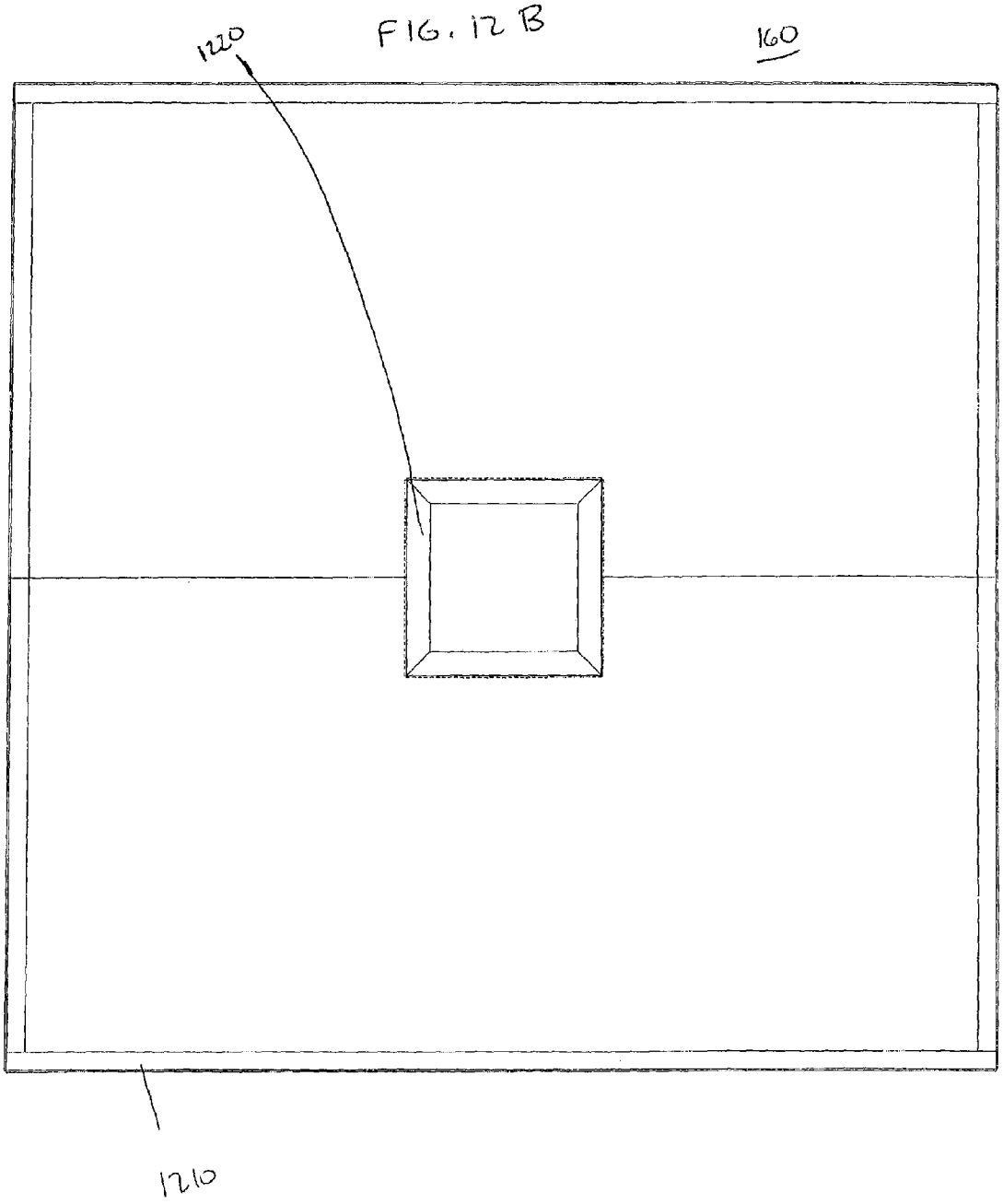
FIG. 12B is a top view of the plate holder base of FIG. 12A for use with the elevated platform of FIG. 1 and in accordance with the present invention.

Referring back to the structure shown in FIGS. 1-3, the elevated platform 100 may also include a base pan 160. FIG. 12A shows an elevated side view of the base pan 160 of FIGS. 1-3. FIG. 12B shows a top view of base pan 160 of FIG. 12A.

Base pan 160 may be constructed of any material. Preferably, base pan 160 is constructed of steel.

Base pan 160 may include a flat panel section 1210 and a tube holder portion 1220. The flat panel section 1210 and the tube holder portion 1220 may be constructed of the same or different materials.

The flat panel section 1210 of base pan 160 is preferably a flat piece of material. The flat panel section may be any shape or size. In preferred embodiments, the flat panel section 1210 has an area equal to or slightly larger than the bladder structure 108 in the deflated position. In some embodiments where the bladder cushions used are 10 feet×10 feet×2 feet in the inflated position, the flat panel section 1210 of base pan 160 may be about 10.5 feet×10.5 feet to accommodate the bladder cushions when in the deflated position. In preferred embodiments, the flat panel section 1210 has a square area with 10-foot-4-inch sides. The flat panel section 1210 of the base pan 160 may have any thickness. In a preferred embodiment, the flat panel section 1210 may be 4 inches thick.

The flat panel section 1210 may be constructed in two separate and identical pieces, such as those shown in FIGS. 12A-B. These two pieces may be arranged so as to form opening 1230. The flat panel section 1210 may be formed as one piece, or more than two pieces. In some embodiments, it may be easiest to use two pieces for the flat panel section 1210 because it may be easiest to acquire two pieces of material of a smaller size than one piece at a larger size. The one or more pieces of flat panel section 1210 may be connected using any known fastening, attaching, or connecting means, including using a nail, screw, bolt, nut, clip, fastener, glue, adhesive, tape, soldering, welding, or any other fastening means. Preferably, pieces of the flat panel section 1210 are welded together.

The flat panel section preferably has an opening 1230. This opening 1230 preferably has dimensions which are slightly larger than the central support structure 130. The opening 1230 preferably is the same dimensions or slightly larger than the cross-section of the bottom tube 140. In preferred embodiments, the opening 1230 is square with sides which are 18.5 inches in length.

The flat panel section 1210 may be connected to the tube holder portion 1220 in any number of ways. In some embodiments, the flat panel section 1210 and the tube holder section 1220 are created, molded, or constructed at the same time and of the same materials. In other embodiments, each may be constructed, manufactured, created, or molded separately and later attached by any number of means, including using a nail, screw, bolt, nut, clip, fastener, glue, adhesive, tape, soldering, welding, or any other fastening means. Preferably, the tube holder section 1220 is welded to the flat panel section 1210.

The tube holder section 1220 may resemble four sides of a box with no top or bottom, or may resemble a cutout portion of a rectangular shaft. The tube holder section 1220 is preferably rectangular, but may be any other shape, including circular, oval, rounded, rectangular, triangular, pentagonal, hexagonal, octagonal, or any other regular or irregular shape. In preferred embodiments, the tube holder section 1220 has the same shape as the central support structure 130, and is the same or slightly larger in size than the cross-sectional size of the bottom tube 140 of the central support structure 130. The length of the tube holder section 1220, from open end to open end, may be any length, and preferably is around 15 inches. As such, when the base pan 160 is viewed from the side, the depth of the tube holder section 1220 is around 15 inches. Each of the sides of the tube holder section may be any size, but are preferably around 24 inches across and approximately 2-4 inches thick.

The tube holder section 1220 may be configured so as to snugly fit next to the central support structure 130. In preferred embodiments, the tube holder section 1220 fits snugly next to bottom tube 140. Tube holder 1220 may form an airtight connection with the central support structure 130 and in particular the bottom tube 140 by using a gasket or any other air-tight materials to seal the base pan to the central support structure 130 at the bottom tube 140. For example, rubber, PVC, metals, cork, paper, silicone, felt, neoprene, nitrile rubber, fiberglass, or a plastic polymer or any other sealants may be used.

Referring back to FIGS. 1 and 2, bladder structure 108 may be located beneath the platform 105. In the deflated position, the platform 105 may rest on top of the deflated bladder structure 108. Because the deflated bladder structure 108 may rest in a cavity 190 slightly below ground level, the platform 105 may be at or near ground level. In preferred embodiments, the cavity 109 is created, dug, or exists at a depth sufficient to allow the platform 105 to rest on top of the bladder structure 108 at or near ground level. Platform 105 is preferably parallel to the ground, but other variations may be possible.

The bottom of the bladder structure 108 may be connected to the flat panel section 1210 of the base pan 160. In some embodiments, the bottom-most bladder cushion 125 is connected to the base pan 160 while all other bladder cushions 110-124 of bladder structure 108 are not connected to the base pan 160. The bladder structure 108 may be connected to the base pan 160 in any number of ways, including using a nail, screw, bolt, nut, clip, fastener, glue, adhesive, tape, soldering, welding, or any other fastening means. In some preferred embodiment, the bottom collar of the bottom cushion 125 is connected to the base pan 160 around the opening 1230. This may be accomplished in some embodiments by screwing, nailing, or bolting the bottom collar of the bladder cushion 125 to the base pan 160. Additionally or alternatively, a bead or layer of caulk or glue may be placed between the bottom collar of the bottom cushion 125 and the base pan 160. Additional or alternative methods of securing the bladder structure 108 to the base pan 160 may be implemented.

As shown in FIGS. 1 and 2, the central support structure 130 may be assembled at least partially inside the tube holder portion 1220 of the base pan 160. In some embodiments, the bottom of the tube holder portion 1220 of base pan 160 is connected to tube 140 of the central support structure 130. In preferred embodiments, this connection is air-tight and durable. In these embodiments, the majority of the central support structure 130, including all of tubes 136-139, is fully encased and/or encompassed in an airtight seal with the bladder structure 108. In this manner, the inflated bladder structure 108 may encase the central support structure 130 and, in conjunction with the outer boundary of tube 140, may represent a completely airtight structure. With the central support structure 130 surrounded by the composite bladder structure 108, the area of the composite bladder structure 108 which otherwise would have required a connection to the central support structure 130 is reduced, thereby reducing the possibility of scratches, tears, or punctures which may have been caused by the central support structure. Additionally, while small levels of air or gas may travel through the bladder cushion 125 into the opening 1230 based on the connection of the bladder cushion 125 to the base pan 160, this opening 1230 may be sealed, air-tight, to the central support structure 130, such that any air escaping the bladder cushion 125 is still trapped or held inside a seal inside the outer edges of the bottom pole 140 and it's base element 930. In some embodiments, the entire central support structure 130 may be encased and/or encompassed within the bladder structure 108.

In preferred embodiments, the base pan 160 functions to connect and form an airtight seal between the bladder structure 108 and the central support structure 130. In preferred embodiments, the base pan 160 may also function to protect the bladder structure 108 from protuberances and other hazards from the ground. The base pan 160 may also form a level and solid base upon which components of the elevated platform 100 may rest and rely. In preferred embodiments, the base pan 160, and in particular the tube holder portion 1230, function to guide the central support structure 130 and provide increased stability from lateral movement of the central support structure in either the elevated or deflated positions.

Referring back to FIGS. 1 and 2, a cavity 190 may also be utilized with the present elevated platform 100. In a preferred embodiment, a deflated bladder structure 108 may fit in the cavity 190.

The cavity 190 may comprise a shallow pit, hole, cavity, enclosure, or space existing in the ground. A much deeper pit, hole, cavity, crevice, enclosure, or space may exist through the center of the cavity 190. This deeper pit or hole may be located in the geographic center of the cavity 190. In preferred embodiments such as those shown in FIGS. 1 and 2, the central support structure 130 may be placed directly through the center of the cavity 190 in this deeper pit or hole.

The depth in the ground of the cavity 190 may be around 6-18 inches deep, and preferably is around 8-12 inches deep. The cavity may be approximately as wide or as long as the cross-sectional dimensions of the bladder structure 108 in the deflated position. These dimensions may be wider than the cross-sectional dimensions of the bladder structure 108 in the inflated position. The cavity 190 may be any shape. In preferred embodiments, the cross-section of the cavity 190 is square with sides between 8 feet and 18 feet, and more preferably 12 feet. In preferred embodiments, the cross-section of the cavity 190 is the same shape and slightly larger in size than the cross-sectional size of the bladder structure 108 in the deflated position.

The edges of the cavity 190 may be sloped or angled. In the elevated position where the area of the cavity 190 is larger than the cross-sectional area of the inflated bladder structure 108, a portion of the cavity 190 may be exposed. Angled or sloped edges of the cavity 190 may present a decreased hazard or risk area when the elevated platform 100 is in this inflated position. The cavity 190 may be configured in a sloped or angled manner so that when the bladder structure 108 is in the inflated position and begins deflating, the bladder structure 108 gathers at the bottom of the cavity and slowly pushes outward. In this manner, an object located at the base of the cavity when the elevated platform 100 is in the inflated position will merely be pushed out of the cavity slowly by the bladder structure 108 as the bladder structure 108 is deflated. This may provide a safety mechanism so that objects are not caught under the bladder structure 108 as it deflates.

The base pan 160 may rest on the bottom of the cavity 190. The base pan may be sloped or angled as mentioned above for the same or similar reasons. The depth of the cavity with the base pan inside of it is preferably around 8 or 9 inches deep.

Additionally, a gate (not shown) may be used with the elevated platform 100 to provide additional protection for users, people, animals, or others on the ground from the exposed cavity when the elevated platform 100 is in the elevated position as shown in FIG. 1. The gate may be similar to a baby gate, in that it may prevent small children or animals from falling into or traveling through the cavity. In some embodiments, the gate may be spring loaded and may stop at 4 feet. The gate may rise as the elevated platform 100 rises to the inflated position, and may also drop down as the elevated platform 100 deflates.

Figure 13:
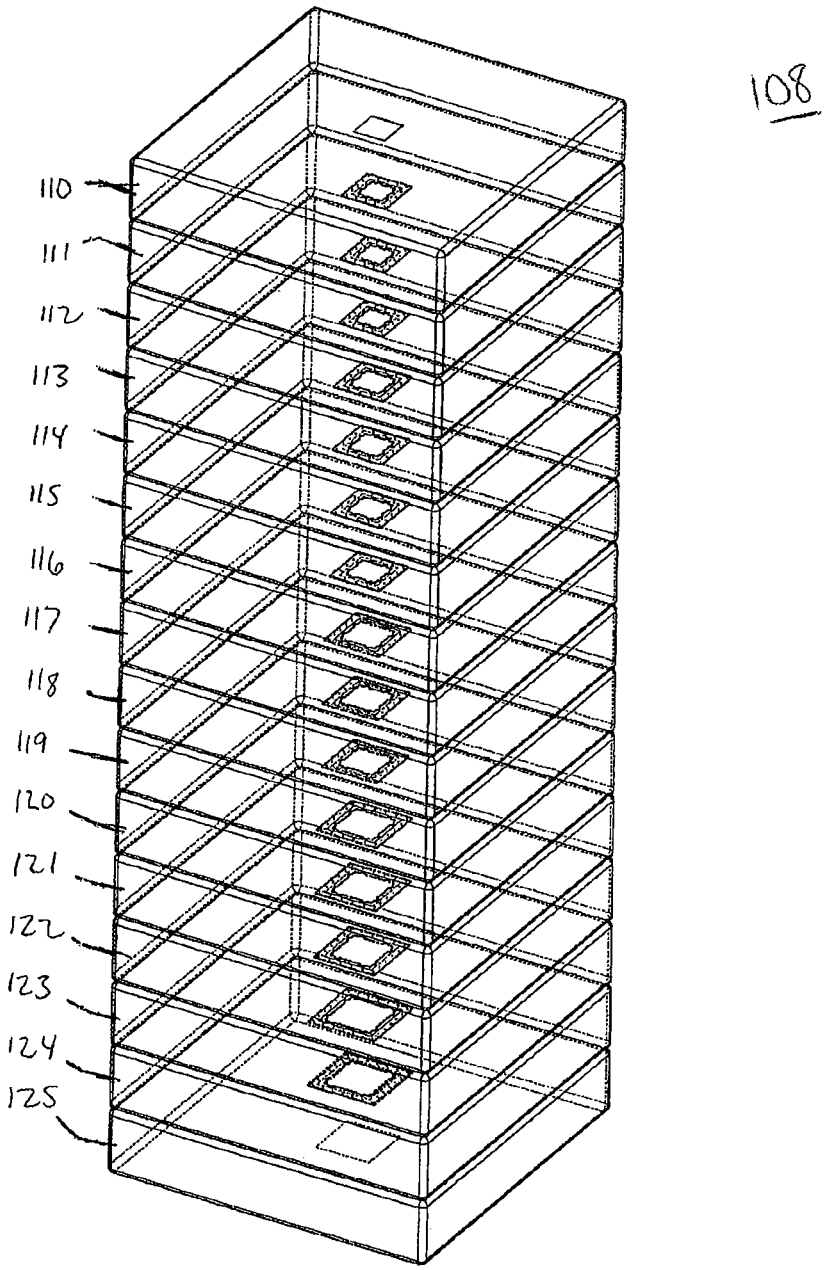
FIG. 13 is a transparent elevated side view of a bladder structure for use with the elevated platform of FIG. 1 and in accordance with the present invention.
Figure 14:
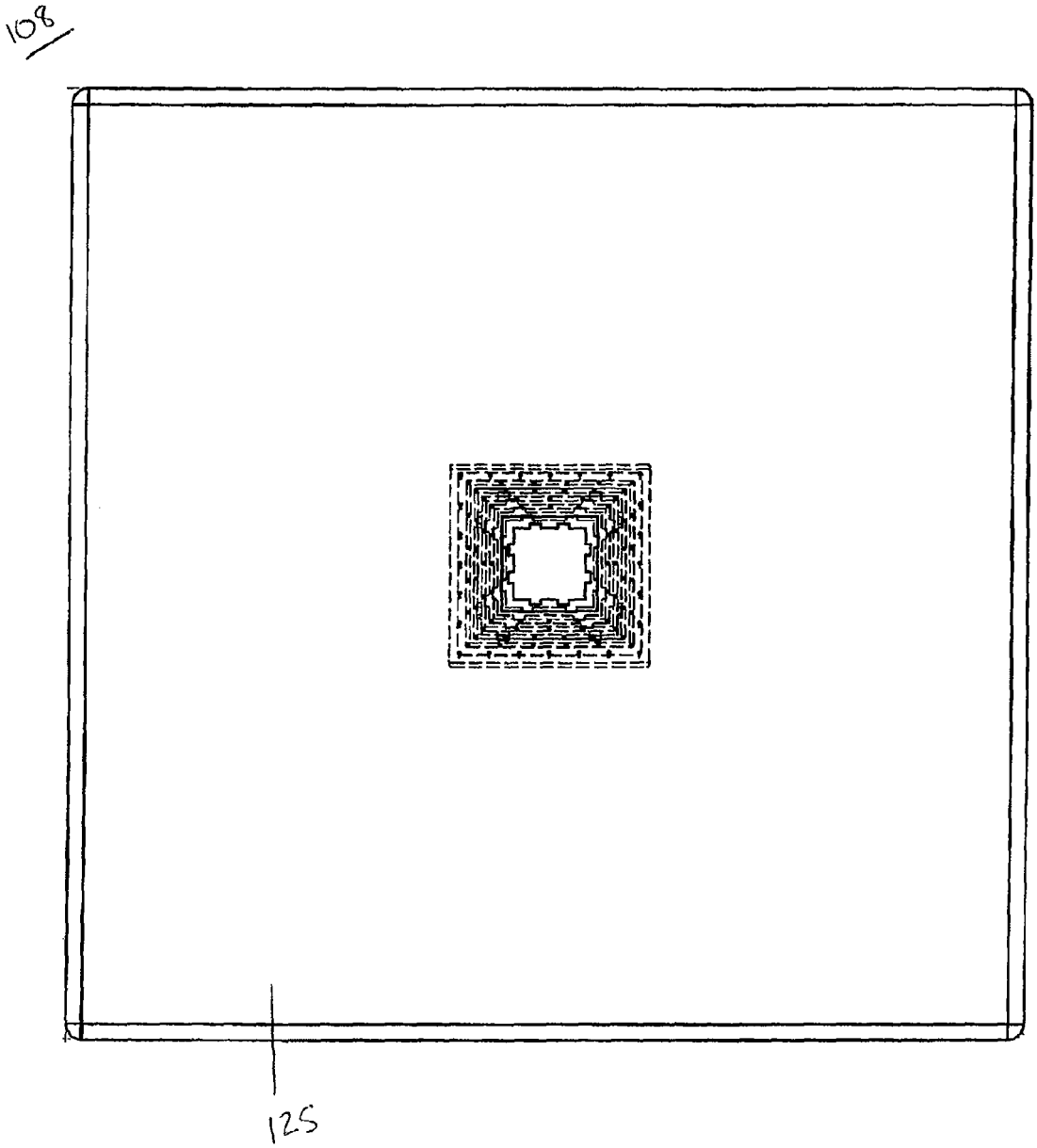
FIG. 14 is a top view of the bladder structure of FIG. 13 for use with the elevated platform of FIG. 1 and in accordance with the present invention.
Figure 15:
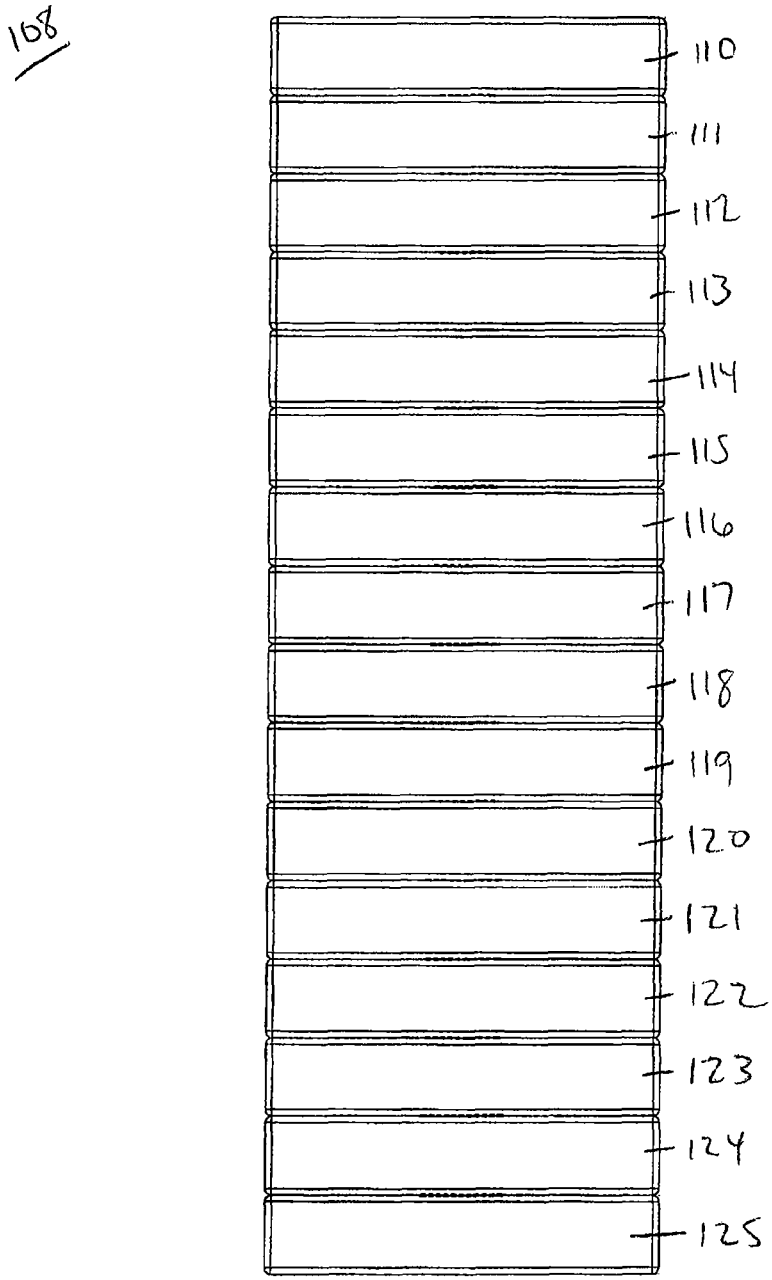
FIG. 15 is a cross-sectional side view of the bladder structure of FIGS. 13 and 14 for use with the elevated platform of FIG. 1 and in accordance with the present invention.

Referring back to the structure of the elevated platform 100 shown in FIGS. 1-3, the bladder structure 108 may include sixteen individual bladder cushions 110-125. The bladder structure 108 is further depicted in FIG. 13, which offers a transparent elevated side view of the composite bladder structure 108 by itself in the elevated position. FIG. 14 shows a bottom view of the bladder structure 108 in FIG. 13, and FIG. 15 shows a side view of the bladder structure 108 in FIGS. 1-3 and 13-14.

Bladder structure 108 is an inflatable structure. While the present disclosure may discuss inflating the bladder structure 108 or any of the individual bladder cushions 110-125 with air or gas, or more particularly with a low pressure, high volume air or gas that is not volatile, it should be appreciated that the bladder structure may be inflated with any number of gases or other fluids, including air, gas, any combination of gases, a liquid, or any combination of the above.

Preferably, bladder structure 108 operates in a fashion similar to a balloon or air cushion, in that when not inflated, bladder structure 108 is comparatively thin and compactable, preferably comprising a few layers of flexible material. As mentioned, in a preferred embodiment, a deflated bladder structure 108 may fit in cavity 190 below platform 105 and above a base pan 160.

In some embodiments, when filled with a suitable substance the bladder structure 108 and/or a number of the individual bladder cushions 110-125 may expand considerably and have a rigid form and may be able to resist a force without the shape of the bladder structure 108 and/or a number of the bladder cushions 110-125 being substantially deformed. The expansions may be facilitated or aided by a flexible material used for the bladder structure 108 and/or bladder cushions 110-125, such that when air is sent into the bladder structure 108 and/or bladder cushions 110-125, the material expands and forms a stiffer or harder exterior of the bladder structure 108.

In preferred embodiments, the bladder structure 108 and/or the bladder cushions 110-125 are air-tight and durable. In one preferred embodiment, the bladder structure 108, when charged with a low pressure substance, is able to resist a force from the platform 105 without releasing air or rupturing. In one exemplary embodiment, the bladder structure 108 and/or the bladder cushions 110-125 comprise a material that is operable to stretch without rupturing. For example, when a force is applied to the top of the bladder structure 108 by platform 105 and the bladder structure 108 is filled with compressed air, the top of the bladder structure 108 is depressed toward the bottom of the bladder structure 108. In this example, the compressed air is displaced horizontally to a first side of the bladder structure 108 that is operable to suitably stretch to a desired width. In an alternative embodiment, the bladder structure 108 does not stretch at all. For example, when the bladder 108 has finished stretching to the desired width, the air pressure inside the bladder 108 is increased as the force is applied to the top of the bladder structure 108. At some point the bladder structure 108 will be rigid enough to increase the pressure (psi) inside the bladder 108 as a force is applied to any or all sides of the bladder 140.

Forces which may be resisted include, but are not limited to, the force created by the weight of the platform 105 and its cargo; the force of gravity; the force of natural elements upon the bladder structure 108 such as, for example, the force of rain, sleet, or snow on the bladder structure, and any other suitable forces. In one exemplary embodiment, the bladder structure 108 is capable of supporting a force preferably between 2,000 and 10,000 pounds, more preferably the bladder structure 108 is capable of supporting a force of about 5,000 pounds.

The bladder structure 108 and/or a number of its bladder cushions 110-125 may comprise a flexible material. For example, the bladder structure 108 and/or a number of its bladder cushions 110-125 can be fabricated of various materials including, but not limited to, rubber, reinforced rubber, a vinyl coated fabric or other suitable material.

In some embodiments, each bladder cushion 110-125 may be made of the same material or combination of materials. In other embodiments, some bladder cushions 110-125 may be made of different materials or combinations of materials than other bladder cushions. Any combination of bladder cushions 110-125 may be made of a number of different materials or combination of materials.

In one embodiment, the thickness of the material used for the bladder structure 108 and/or each bladder cushion 110-125 is preferably between 1/100 inch and ½ inch, more preferably 1/32 inch. The thickness of the material used for the bladder structure 108 is not limited to these thicknesses. For example, the thickness can be smaller or larger depending on the material used to form the bladder structure 108.

In some embodiments, the bladder structure 108 may be manufactured, formed, or created in one piece, with each bladder cushion 110-125 being manufactured, formed, or created as a part of the bladder structure 108. In some of these embodiments, each bladder cushion 110-125 may not be separable from the bladder structure 108. For example, the bladder structure may comprise one large inflatable bladder molded or formed with rubber or plastic, and additionally including molded or formed dividing panels which separate individually inflatable compartments representing the bladder cushions 110-125. In other embodiments, the bladder cushion 110-125 of the bladder structure 108 may each be separately manufactured, formed, or created. In preferred embodiments, the bladder cushions 110-125 may exist and be used as bladders independently of bladder structure 108. One advantage of having bladder cushions 110-125 created separately and later attached to each other is that if one bladder cushions 110-125 is damaged, fixing the bladder structure 108 merely requires replacing one faulty bladder cushion. In a preferred embodiment, individual bladder cushions 110-125 are made separately from each other and attached to each other to form the bladder structure 108.

While the bladder structure shown in FIGS. 1-6 includes sixteen bladder cushions 110-125, the bladder structure 108 may alternatively have fewer or more bladder cushions as desired. For example, the bladder structure 108 may comprise a single bladder with one compartment representing the entire bladder structure 108, or it may have twenty or more bladder cushions. In some embodiments, more bladder cushions may be used to increase the maximum possible height of the elevated platform in the elevated position, or fewer bladder cushions may be used to decrease the maximum possible height of the elevated platform. In other embodiments, the use of more or less bladder cushions may not affect the maximum possible height of the elevated platform.

Figure 16:
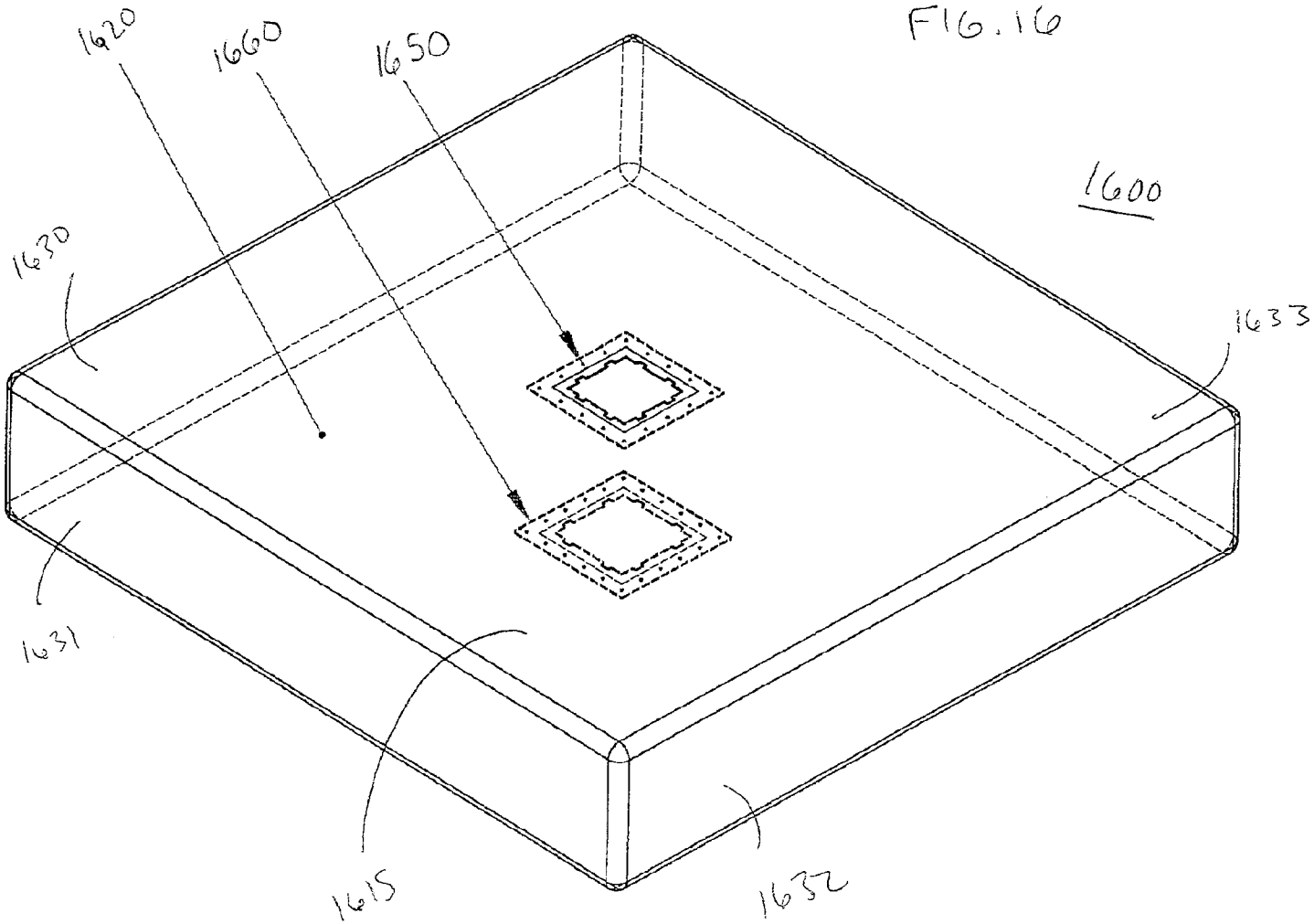
FIG. 16 is a transparent elevated side view of a first embodiment of a bladder cushion for use with the elevated platform of FIG. 1 and in accordance with the present invention.
Figure 17:
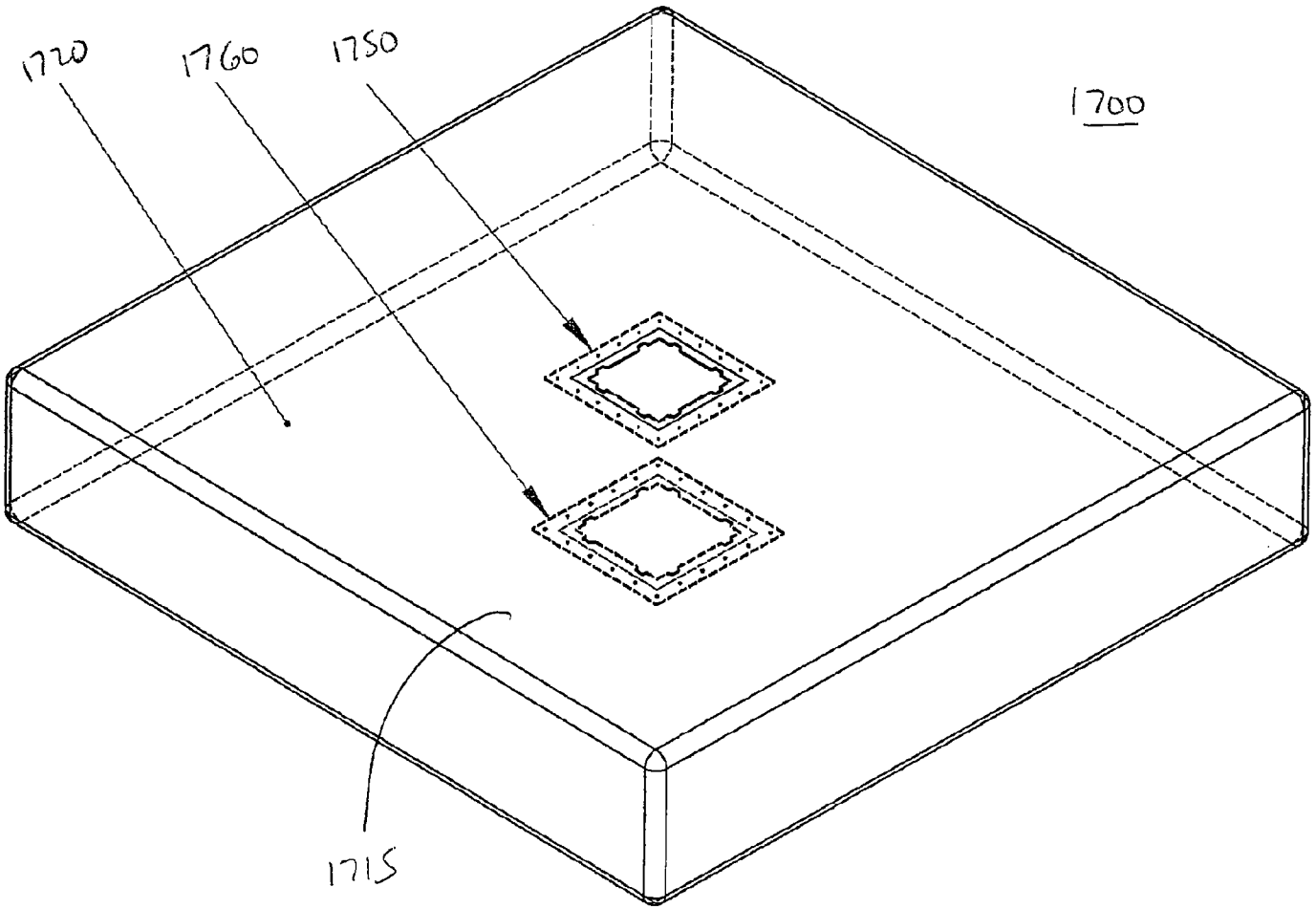

FIGS. 16-17 show elevated transparent side views of two different embodiments of a bladder cushions in the elevated or inflated position. Except where stated otherwise, bladder cushions 1600 and 1700 of FIGS. 16-17 are each generally constructed, manufactured, composed of connected, used, and/or operated in a similar manner. In the following discussion regarding the general characteristics of a bladder cushion, for simplicity, bladder cushion 1600 shown in FIG. 16 will be referenced.

As shown in FIG. 16, in some embodiments, bladder cushion 1600 may be generally box shaped. Alternatively, the bladder cushion 1600 may alternatively be egg-shape, square, rectangular, cylindrical, circular, spherical, ring-shaped, or any other suitable shape. For example, the bladder cushion 1600 may be ring or donut-shaped.

In box-shaped embodiments as in FIG. 16, bladder cushion 1600 may have a top panel 1615, a bottom panel 1620, and four side panels 1630-1633. Additionally or alternatively, bladder cushion 1600 may have a height h, a width w, and a length l. In some of these embodiments, the length l and the width w may be the same such that the top panel 1615 and bottom panel 1620 of the bladder cushion 1600 are squares. Alternatively, the top panel 1615 and bottom panel 1620 may be other shapes, such as circular, oval, rounded, rectangular, triangular, pentagonal, hexagonal, octagonal, or any other regular or irregular shape.

In preferred embodiments, the top panel 1615 and the bottom panel 1620 may be generally parallel to each other. In other embodiments, the top panel 1615 and the bottom panel 1620 may not be parallel.

In some embodiments, top panel 1615 and bottom panel 1620 are the same shape and size. However, in other embodiments, the top panel 1615 may be a different shape or a different size than the bottom panel 1620. For example, the top panel 1615 may be the same shape but a smaller size than the bottom panel 1620. This embodiment may be useful to create an elevated platform with a larger base and a smaller top portion for increased stability. In a preferred embodiment, the top panel 1615 and bottom panel 1620 are approximately the same size and shape, and additionally are parallel to each other. In a more preferred embodiment, the top panel and the bottom panel are parallel and both squares of the same size.

In preferred embodiments, the length l and width w of the bladder cushion 1600 may both be between 5 feet and 15 feet, and more preferably are 10 feet each. However, the length l and width w may be any size and may not be the same size, or may not even exist at all, such as for example where the top panel 1615 and/or bottom panel 1620 are circular or oval shaped.

As noted, each bladder cushion 1600 may have one or more panel such as panels 1630-1633, each with a height h when in the inflated or elevated position. Alternatively, each bladder cushion 1600 may not have a specific panel like panels 1630-1633, but instead may be more rounded, such as in a ring-shaped bladder when in the inflated or elevated position. In these embodiments, the bladder cushion may still stand a certain height h in the inflated or elevated position.

The height h may not be constant for the bladder cushion 1600 in both the inflated position and in the deflated position. In a preferred embodiment, the height h of the bladder cushions 110-125 in the inflated position is between 1 foot and 5 feet, and more preferably is around 2 feet. Other sizes are possible. The height h of each bladder cushion in the deflated position is less than the height h in the inflated position, and preferably is approximately the sum of the thicknesses of the top panel 1615 and the bottom panel 1620.

The height h of each bladder cushion 110-125 in the elevated position may be the same. Alternatively, the height h of each bladder cushion 110-125 in the elevated position may vary. Any combination of bladder cushions 110-125 and heights h is possible.

Preferably, the platform 105 may be elevated to a maximum height which equals the sum of the heights h for the bladder cushions 110-125. The height h of the bladder cushion 1600 in the inflated position may determine the maximum height of the elevated platform 100. When a greater maximum height of the elevated platform 100 is desired, the bladder cushions 1600 may be manufactured, created, or altered to have a greater height h. However, this is not required to increase or decrease the maximum height of the elevated platform 100.

Figure 18:
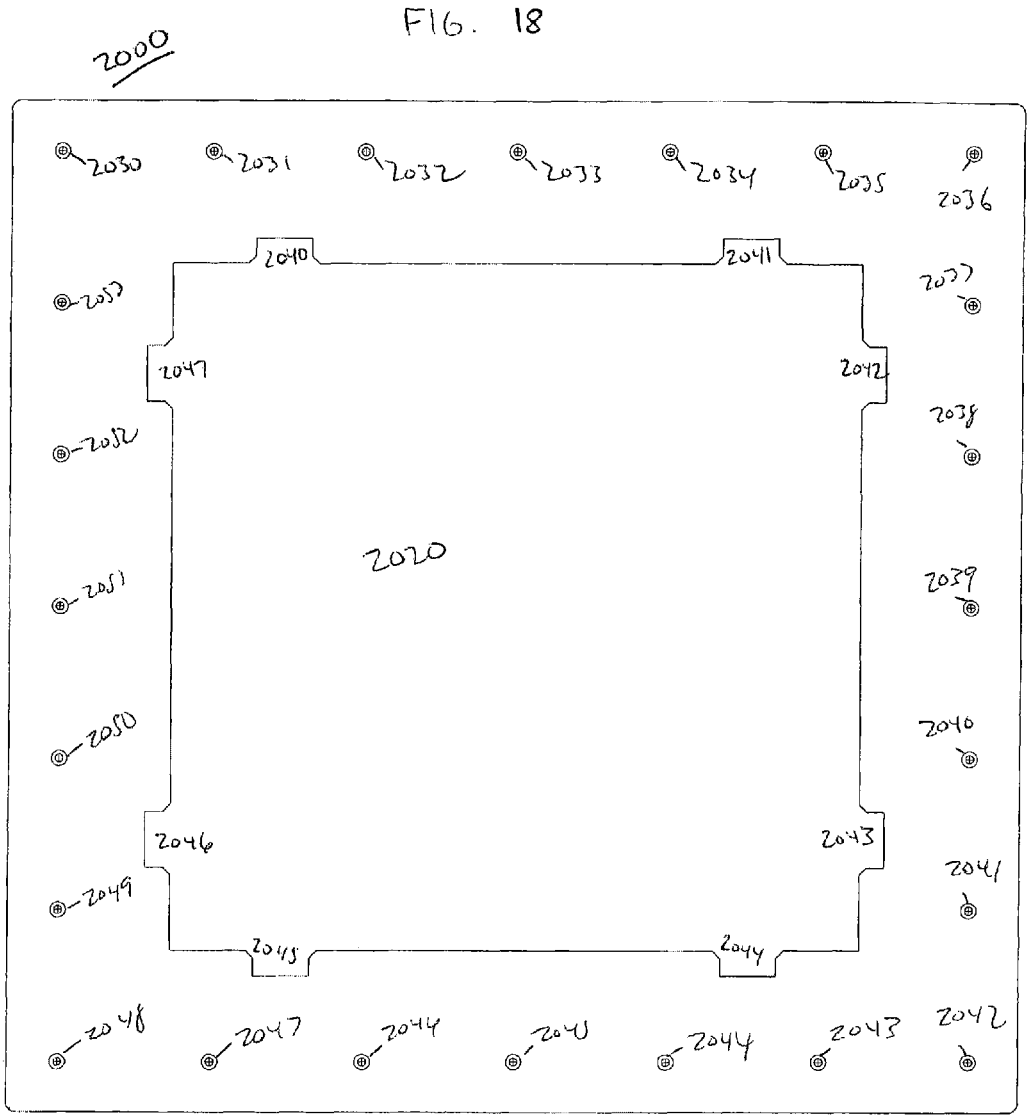
FIG. 18 is a top view of a collar for use with the elevated platform of FIG. 1 and in accordance with the present invention.
Figure 19:
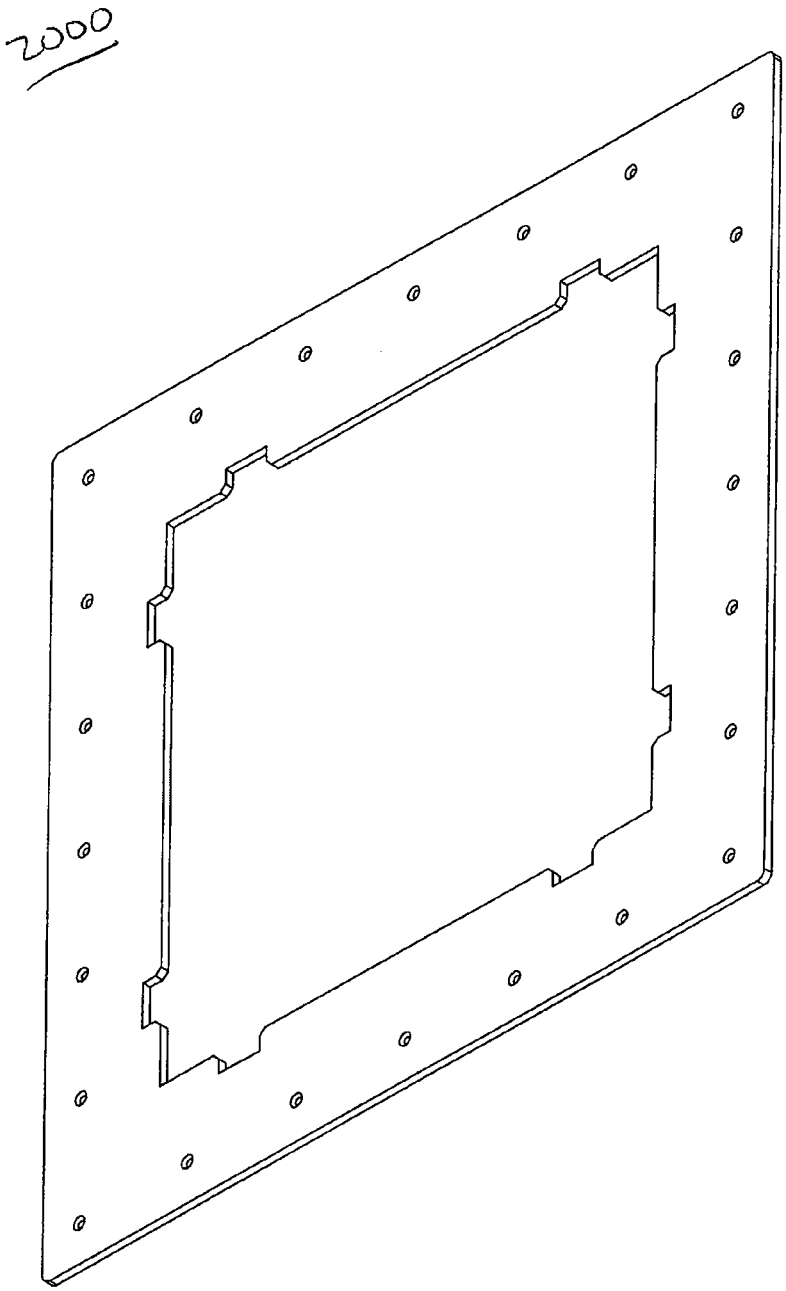
FIG. 19 is a three dimensional side view of the collar of FIG. 18 for use with the elevated platform of FIG. 1 and in accordance with the present invention.

Referring again to FIG. 16, bladder cushion 1600 may include a top panel 1615 with a top collar 1650, and a bottom panel 1620 with a bottom collar 1660. FIG. 18 shows a top view of a collar 2000 which may include an open interior portion 2020 and a series of holes 2030-2053. FIG. 19 shows an elevated side view of the same collar 2000 shown in FIG. 18. Collar 2000 may represent either top collar 1650 or bottom collar 1660 of bladder cushion 1600, or may represent any of the collars in the elevated platform 100.

As shown in FIGS. 18 and 19, collar 2000 may be generally square shaped with a thickness. In alternative embodiments, the collar 2000 may be circular, oval, rounded, rectangular, triangular, pentagonal, hexagonal, octagonal, or any other regular or irregular shape. In the preferred embodiment shown in FIGS. 13 and 15, all of the collars of the bladder structure 108 are the same shape, but some of the collars are different sizes. In some embodiments, all of the collars in the bladder structure 108 are the same shape and size. In other embodiments, some of the collars are different shapes and/or sizes while others are the same shape and size. In other embodiments, all collars are different shapes and/or sizes.

The collar 2000 may be made of PVC material. Alternatively, the collar 2000 may be made of metal, plastic, wood, rubber, vinyl, nylatron, or any other material which may be attached to the bladder. In some preferred embodiments, the collar 2000 is rigid enough to resist bending, but flexible enough to snugly fit next to a support tube. In some preferred embodiments, the collar 2000 has a thickness, best seen in FIG. 19, of ¼ of an inch.

Referring to the collar 2000, the open interior portion 2020 of the collar 2000 is preferably open space surrounded by a boundary which may be roughly square as shown in FIGS. 18 and 19. The boundary of the open interior portion 2020 may have indentations 2040-2047. While the open interior portion 2020 in FIG. 18 is generally square with indentations 2040-2047, the open interior portion 2020 may alternatively be any other shape including circular, oval, rounded, rectangular, triangular, pentagonal, hexagonal, octagonal, or any other regular or irregular shape. In some embodiments, the distance between the open interior portion 2020 and the outer edge of the collar 2000 may be between 1 inch and 8 inches, and in a more preferred embodiment is around 4 inches. In preferred embodiments, the general shape of the open interior portion 2020 may be the same or similar to the cross-section of one of the support tubes 135-140. In some preferred embodiments, the shape of the interior portion 2020 is such that a support tube may fit snugly inside the open interior portion 2020.

As shown in FIGS. 18 and 19, the open interior portion 2020 may have indentations 2040-2047. While the collar 2000 in FIGS. 18 and 19 has eight indentations 2040-2047, other collars may have more or less indentations.

As shown in FIGS. 18 and 19, the indentations 2040-2047 may be roughly rectangular with cutout or rounded edges. Alternatively, the indentations may be any other shape or design, including circular, oval, rounded, rectangular, square, triangular, pentagonal, hexagonal, octagonal, or any other regular or irregular shape. In preferred embodiments, the indentations 2040-2047 roughly match the size and shape of the cross-section of tabs 724-728 in FIG. 7A-B. The indentations may be gaps, spaces, or open areas.

The indentations 2040-2047 may serve multiple purposes in the present invention. As mentioned above, the open interior portion 2020 of the collar 2000 is preferably the same size or slightly bigger than the cross section of one of the support tubes 135-140. The indentations 2040-2047 are preferably created and aligned such that when the shaft of a tube such as tube 139 in FIGS. 7A-B is passed through the open interior portion 2020, the indentations 2040-2047 may also allow the bolts 740-744 to pass through. This may be accomplished by sizing the indentations 2040-2047 to be the same or slightly larger than the bolts 740-744, and additionally aligning the indentations 2040-2047 to be roughly aligned with the bolts 740-744. In preferred embodiments, the exact size of the open interior portion 2020 may depend on the cross-sectional size of the central support structure 130. In preferred embodiments, the indentation is roughly rectangular, with a length of 1.375 inches and a width of 0.625 inches.

In addition, the indentations which exist between the collars and the central support structure 130 may facilitate the movement of small volumes of gas between and among each of the bladder cushions 110-125. This may be aided in embodiments where, as mentioned, the central support structure 130 may be sealed inside of the bladder structure 108, such that air which passes from one bladder cushion 110-125 through the indentation between one of the bladder cushion's collars will necessarily pass through to the adjacent bladder cushion. In this way, for example, if low pressure, high volume gas is blown or pumped into bladder cushion 125 at ground level, as bladder cushion 125 fills with gas, some of the gas slowly seeps through the indentations between the bladder cushion 125's top collar and the bladder cushion 124's bottom collar, and ultimately into the adjacent bladder cushion 124, thereby filling this bladder cushion 124 as well. As these two bladder cushions 124-125 slowly fill, gas passes between the top collar of bladder cushion 124 and into bladder cushion 123. This process may continue all the way up through bladder cushion 110. In this way, sixteen bladder cushions 110-125 may be filled or expanded with gas by blowing or pumping the gas through only one opening in the bladder structure 108. These inflated or filled sixteen bladder cushions 110-125 are each, then, largely inflated independently from each other, such that a puncture, cut, or tear in one of the bladder cushions does not immediately or violently deflate the entire bladder structure 108. Rather, in the same manner which gas passed through the indentations or gaps between the collars and the central support structure during inflation, gas passes through these openings and out of the puncture, cut, or tear. Because the gas is preferably low pressure gas, the deflation process is smooth and gradual.

As shown in FIG. 16, the bladder cushion 1600 may have a top collar 1650 and a bottom collar 1660. The collars 1650 and 1660, which have the same general construction as collar 2000 in FIG. 18, may be connected to the bladder cushion in any number of ways, such as, for example, using nails, straps, clips, hooks, tape, glue, adhesive, nuts and bolts, screws, sewn together, fasteners, welding, soldering or any other fastening means. Preferably, each collar 2000 is connected to the bladder cushion using an adhesive or sealant such as glue or caulk.

The primary difference in the embodiments of the bladder cushions 1600 and 1700 pertains to the size of collars each bladder cushion contains. Bladder cushion 1600 has a top collar 1650 which is the same shape, but has different dimensions, than the bottom collar 1660. The top collar 1650 has a smaller total size, as well as a smaller open interior portion, than the bottom collar 1660. The top collar 1650 may or may not have more or less holes than the bottom collar 1660. In some embodiments, such as those best shown in FIGS. 1, 13, and 15, some of the bladder cushions 110-125, including bladder cushions 113, 117, 120 and 123, may be constructed and operate like bladder cushion 1600 in that each of these bladder cushions 113, 117, 120, and 123 has a top collar 1650 and a bottom collar 1660 of the same shape, but with different dimensions. In each of these instances, as well as in bladder cushion 1600, the top collar 1650 is smaller than the bottom collar 1660. As shown in FIG. 1, this may be useful to best to snugly fit next to a central support structure 130 where central support structure 130 has a different diameter or cross-sectional area at the bottom panel of a bladder cushion than at the top panel of the bladder cushion. For example, as shown in FIG. 1, bladder cushion 120 has a bottom collar which has a larger size to accommodate the larger cross section of tube 138, while bladder cushion 120 also has a top collar which has a smaller size to accommodate the smaller cross section of tube 137, when in the elevated position.

Bladder cushion 1700 differs from bladder cushion 1600 in that the top collar 1750 in bladder cushion 1700 is the same shape and size as the bottom collar 1760. In some embodiments, such as those best shown in FIGS. 1, 13, and 15, some of the bladder cushions 110-125, including bladder cushions 110, 111, 112, 114, 115, 116, 118, 119, 121, 122, 124, and 125 may be constructed and operate like bladder cushion 1700 in that each of these bladder cushions 110, 111, 112, 114, 115, 116, 118, 119, 121, 122, 124, and 125 has a top collar 1750 and a bottom collar 1760 of the same shape and size. As shown in FIG. 1, this may be useful to best to snugly fit next to a central support structure 130 where central support structure 130 has the same diameter or cross-sectional area at the bottom panel of an bladder cushion as it does at the top panel of the bladder cushion. For example, as shown in FIG. 1, bladder cushion 119 has two collars which are the same size, since both collars may be sized to snugly fit next to the tube 137, which has a nearly uniform cross section, in the elevated position.

Referring again to collar 2000 which may represent any of the collars in bladders 1600 or 1700, collar 2000 may be used for multiple purposes. First, collars on adjacent bladder cushions may be aligned and used to connect the two bladder cushions. In preferred embodiments, the top collar of the first bladder cushion, such as bladder cushion 125, is aligned with and has the same dimensions as the bottom collar of the second bladder cushion, such as bladder cushion 124. The size of the top collar of the first bladder cushion may be the same as the bottom collar of the second bladder cushion. This may facilitate or assist in making any connections between the bladder cushions easier and assist in providing alignment of holes. In a preferred embodiment, all of the bladder cushions 110-125 are arranged in this manner, with bladder cushion 110 on the top of the arrangement and bladder cushion 125 on the bottom of the arrangement.

Each of the bladder cushions may be connected to each other in any number of ways such as, for example, using nails, straps, clips, hooks, tape, glue, adhesive, nuts and bolts, screws, sewn together, fasteners, welding, soldering or any other fastening means. In some embodiments, each of the bladder cushions are manufactured or created separately and then bound together, attached or connected to each other, or placed with or next to each other. In a preferred embodiment, the two adjacent collars from bladder cushions 124 and 125 may be aligned, so that the openings and dimensions of the collars are aligned. A sealant, glue, caulk, or adhesive may be placed between the two adjacent collars, which are then pressed together. This sealant, glue, caulk, or adhesive may provide an air-tight seal between the two bladder cushions. In these embodiments, a second fastening means such as a screw or nuts and bolts may also be used to attach the two adjacent collars together. For example, each collar, like collar 2000, may comprise a series of screw holes 2030-2053. These screw holes may be aligned so that screws, nuts or bolts may be used to further attach the two adjacent collars to each other, and may provide a more secure method of attachment than glue, sealant, caulk, or any other adhesive. Other methods of fastening two adjacent collars together may be possible.

A third bladder cushion, such as bladder cushion 123, may be fastened to the second bladder cushion, such that the bottom collar of the third bladder cushion is lined up with or matched with the top collar of the second bladder cushion. The third bladder cushion and the second bladder cushion may then be attached or connected to each other in the same manner as the first bladder cushion with the second bladder cushion. This may be repeated for all of the bladder cushions all the way up to bladder cushion 110. More or less connections may be possible, and may depend on the number of bladder cushions in the bladder structure 108.

Alternatively, in some embodiments, the bladder structure 108 is manufactured as one large bladder structure with dividers which subdivide the bladder structure 108 into a desired number of bladder cushions.

The top bladder cushion 110 may be secured to the top plate 1050 of the top tube 135. This may be done by securing the top collar of the top bladder cushion 110 to the top plate 1050. The top collar of the top bladder cushion 110 may be fastened to the top plate 1050 in any number of ways, including using a nail, screw, bolt, nut, clip, fastener, glue, adhesive, tape, welding, soldering or any other fastening means. Preferably, the top collar of the top bladder cushion 110 may be bolted, nailed, or screwed to the top plate 1050. Additionally or alternatively, glue, sealant, or an adhesive may be used. Preferably, the top bladder structure 110 is secured in an air-tight fashion to the top plate 1050, so that no air may escape through the top of the bladder structure 108.

The bottom bladder cushion 125 may be secured to the base pan 160. This may be done by securing the bottom collar of the bottom bladder cushion 125 to the base pan 160. The bottom collar of the bottom bladder cushion 125 may be fastened to the base pan 160 in any number of ways, including using a nail, screw, bolt, nut, clip, fastener, glue, adhesive, tape, welding, soldering or any other fastening means. Preferably, the bottom collar of the bottom bladder cushion 125 may be bolted, nailed, or screwed to the base pan 160. Additionally or alternatively, glue, sealant, or an adhesive may be used. Preferably, the bottom bladder cushion 125 is secured in an air-tight fashion to the base pan 160, so that no air may escape through the bottom of the bladder structure 108.

In some preferred embodiments, including that of FIG. 1, bladder cushions 113, 117, 120, and 123 of FIG. 1 are generally constructed like bladder cushion 1600 in that they have top and bottom collars of the same shape but of different sizes; and bladder cushions 110, 111, 112, 114, 115, 116, 118, 119, 121, 122, 124, and 125 of FIG. 1 are generally constructed like bladder cushion 1700 of FIG. 17 in that they have top and bottom collars of the same size. In the preferred embodiment of FIG. 1, the size of the collars in bladder cushions 114, 115, and 116 may be larger than the collars in bladder cushions 111 and 112; and the collars in bladder cushions 118 and 119 may be larger than the collars in bladder cushions 111, 112, and 114-116; and the collars in bladder cushions 121 and 122 may be larger than the collars in bladder cushions 111, 112, 114-116, 118, and 119; and the collars in bladder cushion 124 may be larger than the collars in bladder cushions 111, 112, 114-116, 118, 119, 121, and 122.

In preferred embodiments such as the one above, smaller collars may be located near the top of bladder structure 108 while larger collars may be near the bottom of bladder structure 108. As shown in FIGS. 1, 13-15, tubes with smaller cross sections, such as tube 135, may be used at the top of the central support structure 130 in the elevated position, while tubes with larger cross sections, such as tubes 140, may be used near the bottom of the central support structure 130 in the elevated position. Using smaller collars near the top of the bladder structure 108 may aid, facilitate, allow, and/or ensure that the collars and bladder cushions fit snugly with the tubes with a smaller cross section, while the larger collars near the bottom aid and/or ensure that the collars and bladder cushion fit snugly with the tubes with a larger cross section. In a preferred embodiment, the size of the collars is chosen based on the size of the tube and the position of the bladder cushion which will be connected to it.

Alternatively, in some embodiments, no bladder cushions like individual bladder cushion 1600 may be used. In other embodiments, no bladder cushions like bladder cushion 1700 may be used. In still other embodiments, no bladder cushions like either bladder cushion 1600 or 1700 may be used. Any combination of bladder cushions similar to bladder cushions 1600 or 1700 may be possible. The type of bladder cushion useful or necessary for a bladder structure 108 may be chosen, may require, or may otherwise depend on the type, shape, size, and style of central support structure 130 and/or tubes 135-140 in the elevated platform 100. For example, if the central support structure 130 has a constant diameter throughout in both the inflated and deflated positions, no bladder cushions like bladder cushion 1600 may be necessary or useful. This is but one example of many which may exist and influence which bladder cushions may be used and in what combination.

As previously mentioned, the bladder structure 108 may be inflated or blown up using a blower or a pump. The blower may be a blower, a pump, or any other device or means capable of blowing, pumping, injecting, or transferring air or gas from outside of the bladder structure 108 into the interior of the bladders structure 108. The blower may be located next to, or remotely from, the deck. In some embodiments, the blower is in the basement, attic, closet, or separate room in a building near the elevated platform. This may be useful if the blower is noisy during operation. In these circumstances, the blower may be connected to the bladder structure 108 in any manner previously described.

In inflating the bladder structure 108 as noted above through one inflation point in one of the bladder cushions 125, the bladder structure 108 may have, for example, a first square or circular valve (not shown) in the bottom portion of the bladder structure 108. This first valve may operate or be configured so that a tube, pipe, or other connecting means (not shown) may connect the blower to the first valve on the bladder structure 108. In some embodiments, the bladder structure 108 may have a square valve with 2 inch sides. In other embodiments, the bladder structure 108 may have a circular valve with a two inch diameter. The valve may be made of any material such as PVC, metal, plastic, wood, fiberglass, aluminum, carbon fiber, or any other material or combination of materials. In a preferred embodiment, the valve is made of PVC.

The blower may have electronic controls (not shown) which control the operation of the blower. These electronic controls may be on the platform 105. This may allow passengers or users of the platform 105 to control the operation of the blower. The electronic controls may include controls to turn the blower on and off, as well as controls to control the flow of air into or out of the bladder structure 108. In preferred embodiments, when the blower is turned off, a valve closes the opening in the bladder structure 108 where the blower is connected, such that gas or air inside the bladder structure 108 is prevented from escaping or leaving the bladder structure 108 through this valve.

In preferred embodiments, gas may be blown or pumped into the bladder structure 108 at a rate of between 1 cubic foot per minute and 1000 cubic feet per minute, and more preferably at 400 cubic feet per minute. In preferred embodiments, the pressure of the gas in the bladder structure 108 is between ½ psi and 1.5 psi. In preferred embodiments, gas or air will be pumped into the bladder structure 108 so that the platform 105 will rise at approximately two feet per minute.

In some preferred embodiments, such as the embodiments shown in FIGS. 1-3 using those components and features described above, the elevated platform 100 may operate in the following manner.

The bottom of tube 140 of central support structure 130 may be buried into the ground or otherwise stabilized so as to avoid swaying, tipping, rocking, or side to side movement of the elevated platform 100.

In a compressed or deflated position, as shown in FIG. 2, each of tubes 136-139 may be designed so that they may all fit together or be compacted. In this arrangement, the central support structure 130 may rise slightly higher than that of the longest tube, top tube 135. In this position, top plate 1050 may be parallel to the ground, and may rest at or near ground level. The compressed bladder structure 108 may be nearly or completely deflated, and may be compacted or compressed to a cavity located below the top plate 1050.

A platform 105, such as the deck shown in FIGS. 1-3, may be mounted or placed on top of the top plate 1050. The platform may be configured or constructed to hold cargo, such as people, animals, machines, equipment, or any other cargo which may be fit on top of the platform 105. In the deflated position as shown in FIG. 2, the bottom of platform 105 may be nearly or completely parallel to the ground, and may be located at or near ground level, so that passengers and cargo may be loaded from the ground easily onto the platform 105. Preferably, in the deflated position, a person may walk directly onto the platform 105 from the ground level, experiencing little or no step up or down in boarding the platform 105.

In this embodiment, the elevated platform 100 may be raised from the deflated or compressed position shown in FIG. 2 to the inflated or elevated position shown in FIG. 1. For example, the bladder structure 108 may have a closeable or resealable opening or valve near the bottom of the bladder structure 108 through which low pressure, high volume air, gas, or fluid may be blown by a blower and controlled by electronic controls on the platform 105. This low pressure, high volume gas may be pushed into the bladder structure 108 through the use of, for example a blower as previously described. The bladder structure 108 may inflate as the low pressure, high volume gas fills the bladder structure 108.

The bladder structure 108 may be attached to the bottom of top plate 1050 in an air-tight fashion, and may exert a force on the bottom of the top plate 1050 and/or on the bottom of platform 105, with the force exerted generally in the upwards direction. When a sufficient force is exerted on the bottom of top plate 1050, tube 135 may begin to move upwards and out from the compressed or deflated tube position. During this movement, the shaft of tube 135 may slide through the interior of the shaft of tube 136. This movement may continue until tube 135 has extended to the point that pulling element of tube 135 hits, connects with, lines up with, or otherwise engages with the grooves of tube 136. At this point, in a preferred embodiment, the pulling element of tube 135 and groove of tube 136 interlock. This occurs because while the width of the tube 135 is less than the width of tube 136 which allows tube 135 to slide through the interior of the shaft of tube 136, the pulling element of tube 135 may be nearly the same width as the interior of shaft of tube 136, and is wider than the top tube section of tube 136. Grooves in tube 136 are preferably constructed to catch or interlock with the pulling element of tube 135. The pressure and force exerted by the inflating bladder structure 108 may continue to push, propel, or exert a force on the tube 135 in the upward direction. However, because the grooves of tube 136 and the pulling element of tube 135 are interlocked, the interlocked pulling element of tube 135 exerts a force on the grooves of tube 136 in the same direction as the force exerted on the bottom of top plate 1050. When this force is sufficient, tube 136 begins to move out from the compressed or deflated position, and tube 135 continues to move upward as well. Tubes 135 and 136 may continue to move upward together in this manner until the pulling element of tube 136 reaches, and preferably lines up with and engages, the grooves of tube 137. At this point, tube 136 and tube 137 interact in the same manner that tube 135 and 136 interacted, and if a sufficient force is exerted, tube 137 may also be disengaged from the compressed position, such that tubes 135-137 may all continue to move upward as the bladder structure 108 continues to inflate. This process may continue in this manner with tubes 138 and 139. However, when tubes 135-139 have all moved upward to a position as shown in FIG. 1, such that the pulling element of tube 139 has lined up with grooves of tube 140, the central support structure 140 may not expand any further. At this point, the pulling element of tube 139 may line up with and engage grooves of bottom tube 140. However, bottom tube 140 may not be capable of expanding or moving upward because bottom tube 140 may be buried in the ground or otherwise affixed in a generally unmovable position. The central support structure 130 may, in this way, expand or extend along an axis which runs vertical and through the center of the bladder structure 108. The central support structure 130 may contract, retract, compact, or otherwise shrink in size as the tubes 135-140 fall back into each other when the bladder structure 108 deflates.

In preferred embodiments, the bladder structure 108 may be constructed of a sufficient number of bladder cushions 110-125, each of a sufficient height so that when the bladder structure 108 is fully inflated, the central support structure 130 is also nearly or fully expanded. In this manner, the bladder structure 108 may not exert a force on the top plate 1050 beyond the force useful for expanding the central support structure 130 to the position shown in FIGS. 1 and 3.

When fully inflated as shown in FIGS. 1 and 3, the inflation device used to inflate the bladder structure 108 may be turned off. In preferred embodiments, when a maximum height is achieved, the electronic controls for the blower automatically shut down the blower, or signal for the manual shut down of the blower. When the blower automatically shuts down the blower, the valve at the bottom of the bladder structure 108 through which gas was being blown is automatically closed. Because the bladder structure 108 is generally air tight and durable with an air tight seal formed between the bladder structure 108 and the central support structure 130, the air in the bladder structure 108 may not escape, and the bladder structure 108 may remain in the inflated or elevated position.

The elevated platform 100 may be lowered from the raised position to the lower position by releasing the air, gas, or fluid from the bladder structure 108 such that this air, gas, or fluid may flow out of the bladder structure. Pressure from the platform 105 and gravity may cause the bladder structure 108 to deflate. Preferably, the inflated bladder structure 108 is inflated with low pressure, high volume gas, so that when this gas is released from the bladder structure 108, the gas slowly or gradually escapes the bladder structure 108. As the bladder structure 108 deflates, the pressure which was previously exerted on the bottom of the top plate 1050 and/or the platform 105 is gradually reduced. As such, the tubes may begin to compact back towards their compressed position as shown in FIG. 2. In some embodiments, this starts as the pulling element of tube 139 is first disengaged from the grooves of tube 140, with tube 139 sliding back through the interior shaft of tube 140, and continues until all the tubes 135-140 have again reached the compacted position shown in FIG. 2.

Air may be purposefully released from the bladder structure 108 in at least two ways. In one way, electronic controls for the blower may include controls to lower the bladder structure 108 by controlling the valve near the bottom of the bladder structure 108. The electronic controls may allow this bottom valve to be opened and allowing the gas or air to escape from the bladder structure 108. This may be the normal or standard way to move from the inflated to deflated positions. However, the elevated platform 100 may also include a second way to move the platform 105 to the deflated position. The bladder structure 108 may include a second valve near the top of the bladder structure 108. The second valve may be closed during all normal operation of the elevated platform 100, but may be opened manually by passengers or users on the platform 105 when desired, such as, for example, during electrical failures with the electronic controls of the blower. In these circumstances, manually opening the second valve near the top of the bladder structure 108 may allow the air or gas to escape from the bladder structure 108, and in this way, allow the platform 105 to slowly descend to the deflated position shown in FIG. 2. It may be preferred to manually operate this second valve for descent only in cases of emergencies, because in some embodiments, when the platform 105 is deflated in this manner, the bottom valve will remain in the closed position once the bladder structure 108 is deflated, which may require manual effort to then open again so that gas or air can again be filled into the bladder structure 108. The second valve located at the top of the bladder structure 108 may be constructed and made of the same or similar materials as the first valve near the bottom of the bladder structure 108.

The elevated platform 100 described herein may provide a number of benefits and advantages including many already described. This elevated platform 100 may allow, facilitate, support, and/or carry users of the platform 105 from a ground position to an elevated position in order to gain an elevated view of the landscape and features surrounding the elevated platform 100. The elevated platform 100 may facilitate repeated uses and may be durable so as to last as long as 15 years with repeated raising and lowering of the elevated platform 100.

In a preferred embodiment, the bladder cushions 110-125 are filled with low pressure, high volume gas, with each bladder cushion 110-125 sealed off from each other bladder cushion 110-125 except for small indentations between the collars of the bladder cushions 110-125 and the central support structure 130 which allow a small volume of air to pass between the bladder cushions 110-125. A benefit to using low pressure, high volume gas for inflating the bladder structure 108 may be a general resistance to violent or volatile deflations when the bladder structure 108 or any of the bladder cushions 110-125 are punctured. Because the gas inside the bladder structure 108 and/or bladder cushions 110-125 is held at a low pressure in comparison to the outside pressure, when punctured, neither the bladder structure 108 nor any of the bladder cushions 110-125 will explode or rapidly lose any gas or air which they were inflated with. Rather, a punctured bladder structure 108 or bladder cushion 110-125 will slowly seep out gas and air, gradually deflating the punctured bladder cushion. Advantageously, because small indentations allow a small volume of gas to be exchanged between adjoining bladder cushions 110-125, when one bladder cushion 110-125 is punctured, if left unattended, eventually all of the air of the bladder structure 108 will slowly escape as well, gradually lowering the platform 105 from an elevated position to a deflated position, and avoiding any abrupt or dangerously fast descent. Another advantage to using low pressure, high volume air is that there may be little or no condensation, and therefore may be no need to dry the air or gas which is blown into the bladder structure 108.

In some embodiments, because low pressure, high volume gas or air is used, in the event of a punctured bladder structure 108 or bladder cushions 110-125, the blower may be activated to blow or pump a steady stream of continuous low pressure, high volume air back into the bladder structure 108 at roughly the rate of air lost through the puncture. In these embodiments, the bladder structure 108 may not deflate noticeably or at all. This may provide the elevated platform 100 with a rugged and durable quality and increase the life of any such elevated platform 100, bladder structure 108, and bladder cushions 110-125.

As such, the elevated platform 100 may provide at least two ways to safeguard passengers from unencumbered and rapid descent of platform 105 in the event of a punctured bladder structure 108. The first may be the use of a blower to keep the bladder structure inflated. The second such safeguard, as mentioned, may be the use of a bladder structure 108 which is subdivided into sections such as bladder cushions 110-125 each connected to each other by small holes, so that when a bladder cushion 110-125 is punctured, the entire bladder structure 108 does not rapidly lose low pressure, high volume gas, but instead gradually seeps the gas until the entire bladder structure 108 is deflated.

The elevated platform 100 may be additionally advantageous over scissors-lifts in that when a scissors-lift loses power, passengers may be stranded at a height until power can be restored. In the elevated platform 100, however, if power is lost, the bladder structure 108 may be manually deflated using a second valve near the top of the bladder structure 108 so that passengers safely and slowly descend to the ground in a safe manner.

In preferred embodiments, the central support structure 130 may be sealed or encased inside bladder structure 108. In this way, the central support structure 130 may provide support for the inflated bladder structure 108 from inside the bladder structure 108 itself, thereby mounting the inflatable bladder structure 108 to the ground without requiring a number of external connections which might otherwise present potential ripping, tearing, puncturing, or other unwanted interference.

Another advantage of the present elevated platform 100 is that, because of the function of the central support structure 130 which prevents lateral movement of the elevated platform 100, the elevated platform 100 is stable even at intermediate heights between the inflated position of FIG. 1 and the deflated position of FIG. 2. Such stability may be in that the platform 105 may be largely parallel with the ground below it, the platform 105 may be able to support cargo and users which may be able to move about the platform 105 comfortably and without tipping or moving the platform 105, and the elevated platform 100 may not sway, tip, or move much laterally or vertically, and further that some or all of the features may be accomplished without the use of any additional devices or equipment such as restraints, wires, cables, locking mechanism, hydraulics, or other such devices or equipment. In this way, the elevated platform 100 is capable of stably achieving any height between these positions without the use or aid of an external support system, features, or structure.

An advantage of the elevated platform 100 achieved by using the central support structure 130 is that the elevated platform is stable and secure at any intermediate height level between the elevated position shown in FIGS. 1 and 3 and the deflated position shown in FIG. 2.

Another advantage is that the bladder structure 108 may be large enough so that when inflated with a low pressure gas, the bladder structure 108 may be held in a position which is stable and resists lateral movement through the use of the central support structure 130 running through the middle of the bladder structure 108. This may be the result of the low pressure gas, the high volume of gas, and/or the use of a central support structure 130 that may be held in an upraised position merely by the tensile strength of the bladder structure 108 which it is attached to.

Various embodiments described herein can be used alone or in combination with one another. The forgoing detailed description has described only a few of the many possible implementations of the present invention. For this reason, this detailed description is intended by way of illustration, and not by way of limitation. It is only the following claims, including all equivalents that are intended to define the scope of this invention.

The invention claimed is:

1. An elevated platform comprising:

a platform;

an inflatable bladder structure coupled to the platform and operable to raise or lower the platform from a first position to a second position using low pressure, high volume gas;

a cavity, where in the first position, the inflatable bladder structure resides in the cavity below the platform so that the platform is generally parallel and aligned with the ground; and a stabilizing element centrally coupled beneath the platform that resists lateral movement, wherein the stabilizing element is encased by the inflatable bladder structure.

2. The elevated platform of claim 1, where the inflatable bladder structure is operable to raise the platform by being inflated with low pressure, high volume gas, expanding in an upward direction, and exerting a pressure on the bottom of the platform.

3. The elevated platform of claim 2, where the inflatable bladder structure further comprises:

a top valve manually operable from the platform to release the low pressure, high volume gas from within the inflatable bladder structure; and a bottom valve electronically operable by electronic controls and connected to a blower operable to blow the low pressure, high volume gas into the inflatable bladder structure;

where the electronic controls are located on the platform, are configured to control the blower and the bottom valve, and are further configured to electronically monitor the pressure and volume of low pressure, high volume gas in the bladder structure.

4. The elevated platform of claim 2, where the inflatable bladder structure comprises a plurality of individual bladder compartments separate from each other except for small gaps between adjacent individual bladder compartments through which gas may travel, so that if any one of the plurality of individual bladder compartments are ruptured, the inflatable bladder structure will slowly deflate.

5. The elevated platform of claim 2, where the stabilizing element comprises a central support structure extending through the inflatable bladder structure.

6. The elevated platform of claim 5, where the central support structure is configured to resist lateral movement and stabilize the elevated platform by preventing tipping.

7. The elevated platform of claim 1, where the cavity is gradually sloped and configured so that when the elevated platform moves from the second position to the first position, the bladder structure first gathers at the bottom and center of the cavity and then pushes objects within the cavity outward as the bladder structure deflates.

8. An elevated platform comprising:

a bladder structure comprising:

a plurality of bladder cushions each comprising:

a body with a top panel, a bottom panel, side panels, a top central opening in the center of the top panel, a bottom central opening in the center of the bottom panel, a top collar attached to and forming an air-tight seal with the top central opening, and a bottom collar attached to and forming an air-tight seal with the bottom central opening;

a top valve providing an air-tight seal with the bladder structure when closed and manually operable to release air from within the bladder structure when open;

a bottom valve providing an air-tight seal with the bladder structure when closed and operable to release air from within the bladder structure when open;

a central support structure aligned through the top collars and bottom collars of the bladder cushions, the central support structure comprising:

a stationary bottom tube comprising bottom grooves;

at least one middle tube partially encased by the bottom tube, the at least one middle tube comprising:

middle grooves; and a middle pulling element;

a top tube partially encased by the at least one middle tube and coupled to the bladder structure, the top tube comprising:

a top pulling element configured to align with the middle grooves when the top tube has moved a first distance outward from the at least one middle tube; and a top plate;

where the middle pulling element is configured to align with the bottom grooves when the at least one middle tube has moved a second distance outward from the bottom tube;

a base pan attached to and forming an air-tight seal with the bottom collar of the bottom-most bladder cushion of the plurality of bladder cushions and with the bottom tube;

a blower coupled to the bottom valve and operable to blow air into the bladder structure when the bottom valve is open;

electronic controls coupled to the blower and operable to control the flow of air from the blower into the bladder structure;

a platform coupled to the bladder structure and the top plate;

where the top plate forms an air-tight seal with the top collar of the top-most bladder cushion of the plurality of bladder cushions;

where each subsequent bladder cushion located directly below the previous bladder cushion is attached so that the bottom collar of the previous bladder cushion is attached to and forms an air-tight seal with the top collar of the bladder cushion located directly below the previous bladder cushion until the top collar of the bottom-most bladder cushion has been attached;

where the top collars and bottom collars are sized and shaped so that they generally fit snugly around the circumference of the central support structure when the bladder structure is fully inflated;

where when the bladder structure is inflating, the bladder structure exerts a force on the bottom of the top plate that raises the platform and moves the top tube outward from the at least one middle tube until the top tube has moved a first distance and the top pulling element is aligned with the middle grooves, after which the force exerted moved the top tube and the at least one middle tube outward from bottom tube until the at least one middle tube has moved a second distance and the middle pulling element is aligned with the bottom grooves, after which the electronic controls automatically shut off the blower and close the bottom valve.

9. The elevated platform of claim 1, wherein the stabilizing element is a central support structure which comprises a free-standing pole of a desired height which is not compacted, wherein the free-standing pole extends through a central opening of the platform.

10. The elevated platform of claim 1, wherein a portion of the stabilizing element as the central support structure is anchored or attached to an immovable structure for stabilizing the platform at an elevated position from tipping or swaying sideway movement.

11. The elevated platform of claim 10, wherein the anchoring or attaching to the immovable structure comprises one of: anchoring to a concrete foundation, anchoring to a concrete block, partially buried in a hole of the ground, partially buried in a hole of a rock, attaching to a building or attaching to an immovable sturdy object.

12. The elevated platform of claim 10, wherein the central support structure comprises a base element flange which facilitates anchoring of the central support to the immovable structure.

* * * * *